US009117398B2

(12) United States Patent
Jeong et al.

(10) Patent No.: US 9,117,398 B2
(45) Date of Patent: Aug. 25, 2015

(54) DATA RENDERING METHOD, DATA RENDERING DEVICE, AND DISPLAY INCLUDING THE DATA RENDERING DEVICE

(75) Inventors: Geun-Young Jeong, Yongin-si (KR); Won-Woo Jang, Yongin-si (KR); Jong-Woong Park, Yongin-si (KR); Joo-Hyung Lee, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 274 days.

(21) Appl. No.: 13/596,310

(22) Filed: Aug. 28, 2012

(65) Prior Publication Data

US 2013/0241946 A1 Sep. 19, 2013

(30) Foreign Application Priority Data

Mar. 16, 2012 (KR) ..... 10-2012-0027320

(51) Int. Cl.
*G09G 5/02* (2006.01)
*G09G 3/20* (2006.01)

(52) U.S. Cl.
CPC ..... *G09G 3/2074* (2013.01); *G09G 5/028* (2013.01); *G09G 2300/0452* (2013.01)

(58) Field of Classification Search
CPC ..... G09G 5/02; G06T 11/001
USPC ..... 345/589
See application file for complete search history.

(56) References Cited

U.S. PATENT DOCUMENTS 7,184,066 B2 2/2007 Elliot et al.
2004/0196302 A1 * 10/2004 Im et al. ..... 345/690
2005/0025548 A1 2/2005 Kim
2005/0083356 A1 * 4/2005 Roh et al. ..... 345/698
2005/0225548 A1 10/2005 Han et al.
2005/0225563 A1 * 10/2005 Brown Elliott et al. ..... 345/604
2006/0238649 A1 * 10/2006 Brown Elliott et al. ..... 348/441
2006/0284872 A1 12/2006 Brown Elliott
2007/0182756 A1 8/2007 Brown Elliott et al.
2009/0046108 A1 2/2009 Brown Elliott
2011/0043553 A1 * 2/2011 Brown Elliott et al. ..... 345/694

FOREIGN PATENT DOCUMENTS

KR 10-2009-0122307 A 11/2009
WO WO 2006/127555 A2 11/2006

OTHER PUBLICATIONS

EPO Office action dated Mar. 25, 2014, for corresponding European Patent application 12196276.5, (6 pages).

* cited by examiner

*Primary Examiner* — Devona Faulk
*Assistant Examiner* — Jin Ge
(74) *Attorney, Agent, or Firm* — Christie, Parker & Hale, LLP

(57) ABSTRACT

A method for rendering input data into target data includes: applying a pattern detecting window to the input data about an input pixel to detect a green light emitting pattern within the window; determining whether the detected green light emitting pattern belongs to a threshold pattern in which at least two green subpixels that are contiguously arranged emit light; and rendering the target data for a red or blue target subpixel having a first color by: applying a first filter to the input data of the first color red or blue input subpixels that are near the input pixel when the detected green light emitting pattern does not belong to the threshold pattern; and applying a second filter that is different from the first filter to the input data of the first color red or blue input subpixels when the detected green light emitting pattern belongs to the threshold pattern.

23 Claims, 20 Drawing Sheets

FIG. 6

| | | |
|---|---|---|
| 0 | b | 0 |
| b | a | b |
| 0 | b | 0 |

Diamond filter (a+4b=1)

FIG. 7

| | | |
|---|---|---|
| -c | b | -c |
| b | a | b |
| -c | b | -c |

Diamond sharpening filter (a+4b-4c=1)

FIG. 8

| | | |
|---|---|---|
| | b | |
| | a | |
| | | |

Vertical spread filter
(a+b=1)

FIG. 9

| | | |
|---|---|---|
| | | |
| b | a | |
| | | |

Horizontal spread filter
(a+b=1)

FIG. 10

| | | |
|---|---|---|
| | b | |
| c | a | |
| | | |

Horizontal / vertical spread filter
(a+b+c=1)

FIG. 11

| | | |
|---|---|---|
| | b | |
| b | a | b |
| | b | |

Second horizontal / vertical spread filter 2
(a+4b=1)

DATA RENDERING METHOD, DATA RENDERING DEVICE, AND DISPLAY INCLUDING THE DATA RENDERING DEVICE

CROSS-REFERENCE TO RELATED APPLICATION

This application claims priority to and the benefit of Korean Patent Application No. 10-2012-0027320, filed in the Korean Intellectual Property Office on Mar. 16, 2012, the entire content of which is incorporated herein by reference.

BACKGROUND (a) Field

Aspects of embodiments of the present invention relate to a data rendering method and device, and a display device including the data rendering device.

(b) Description of the Related Art

A display device may employ a red/green/blue (RGB) stripe configuration having red/green/blue subpixels for each pixel, where the green subpixels are between the red and blue subpixels in each pixel. Likewise, a display device may employ a pentile configuration including pentile-type pixels. A pentile-type pixel differs from an RGB pixel in that the pentile pixel does not include all three colors of subpixels.

FIG. 1 is a schematic diagram of an example of the pentile configuration, showing example pentile pixels arranged in a matrix, with a couple of RGB pixels shown for comparison. As illustrated in the legend for FIG. 1, a first block (or block pattern) represents a red subpixel, a second block shows a green subpixel, and a third block indicates a blue subpixel.

Referring to the pentile configuration of FIG. 1, a pentile pixel corresponds to one RGB pixel of an RGB stripe configuration, only the pentile pixel does not include a red subpixel or a blue subpixel. Instead, the red subpixels and the blue subpixels of the pentile configuration alternate in a checkerboard-like arrangement. Such a pentile configuration has only two-thirds of the number of subpixels of a corresponding RGB configuration.

However, since each pentile pixel lacks either a red subpixel or a blue subpixel, the input data for RGB stripe pixels may need to be rendered through a filter for each color channel in order to drive a pentile-type display to display a comparable image to the RGB display. Such a rendering may cause noticeable differences in the displayed images on the pentile display when compared to the RGB display.

The above information disclosed in this Background section is only for enhancement of understanding of the background of the invention and therefore it may contain information that does not form the prior art that is already known in this country to a person of ordinary skill in the art.

SUMMARY

Aspects of embodiments of the present invention relate to a method and device for rendering RGB stripe-type input data into data that is appropriate for a pentile configuration, and a display device including the data rendering device. Further aspects of embodiments of the present invention improve readability and resolution on pentile displays driven with RGB input data when precise patterns or characters are expressed in a pentile pixel configuration with red or blue subpixels as members.

According to an exemplary embodiment of the present invention, a method for rendering input data for input pixels including green subpixels and red or blue input subpixels into target data for target pixels including red or blue target subpixels is provided. The method includes applying a pattern detecting window with a predetermined size to the input data about one of the input pixels to detect a green light emitting pattern of ones of the green subpixels within the pattern detecting window, determining whether the detected green light emitting pattern belongs to a threshold pattern in which at least two of the ones of the green subpixels that are contiguously arranged emit light exceeding a first luminance value, and rendering the target data for one of the red or blue target subpixels of a corresponding one of the target pixels that corresponds to the one of the input pixels and has a first color by applying a first filter to the input data of said first color ones of the red or blue input subpixels that are near the one of the input pixels when the detected green light emitting pattern does not belong to the threshold pattern, and applying a second filter that is different from the first filter to the input data of the first color ones of the red or blue input subpixels that are near the one of the input pixels when the detected green light emitting pattern belongs to the threshold pattern.

The method may further include moving the pattern detecting window to render the target data for another one of the red or blue target subpixels.

The predetermined size may encompass input pixels from at least three rows of input pixels and at least three columns of input pixels.

The threshold pattern may include a horizontal pattern in which the at least two of the ones of the green subpixels that are contiguously arranged are arranged in a horizontal direction. The applying of the second filter may include multiplying the input data of a said first color one of the red or blue input subpixels of the one of the input pixels by a first filter variable to generate a first product, multiplying the input data of a said first color one of the red or blue input subpixels of a neighboring top or bottom one of the input pixels of the one of the input pixels by a second filter variable to generate a second product, and adding the first product and the second product.

A sum of the first filter variable and the second filter variable may be 1.

The threshold pattern may include a vertical pattern in which the at least two of the ones of the green subpixels that are contiguously arranged are arranged in a vertical direction. The applying of the second filter may include multiplying the input data of a said first color one of the red or blue input subpixels of the one of the input pixels by a first filter variable to generate a first product, multiplying the input data of a said first color one of the red or blue input subpixels of a neighboring left or right one of the input pixels of the one of the input pixels by a second filter variable to generate a second product, and adding the first product and the second product.

A sum of the first filter variable and the second filter variable may be 1.

The applying of the second filter may include multiplying the input data of a said first color one of the red or blue input subpixels of the one of the input pixels by a first filter variable to generate a first product, multiplying the input data of a said first color one of the red or blue input subpixels of a neighboring top or bottom one of the input pixels of the one of the input pixels by a second filter variable to generate a second product, multiplying the input data of a said first color one of the red or blue input subpixels of a neighboring left or right one of the input pixels of the one of the input pixels by a third filter variable to generate a third product, and adding the first product, the second product, and the third product.

A sum of the first filter variable, the second filter variable, and the third filter variable may be 1.

The applying of the second filter may further include multiplying the input data of a said first color one of the red or blue input subpixels of a different neighboring one of the input pixels of the one of the input pixels by a fourth filter variable to generate a fourth product, and adding the first product, the second product, the third product, and the fourth product.

A sum of the first to the fourth filter variables may be 1.

The applying of the second filter may further include multiplying the input data of a said first color one of the red or blue input subpixels of another different neighboring one of the input pixels of the one of the input pixels by a fifth filter variable to generate a fifth product, and adding the first product, the second product, the third product, the fourth product, and the fifth product.

A sum of the first to the fifth filter variables may be 1.

The threshold pattern may include a cross pattern in which the at least two of the ones of the green subpixels that are contiguously arranged are arranged to cross in a vertical direction and a horizontal direction.

According to another exemplary embodiment of the present invention, a device for rendering input data for controlling brightness of input pixels having an RGB stripe configuration and including green subpixels and red or blue input subpixels, into target data for target pixels having a pentile configuration and including red or blue target subpixels is provided. The device includes: a pattern detector for applying a pattern detecting window with a predetermined size to the input data about one of the input pixels to detect a green light emitting pattern of ones of the green subpixels within the pattern detecting window, and determining whether the detected green light emitting pattern belongs to a threshold pattern in which at least two of the ones of the green subpixels that are contiguously arranged emit light exceeding a first luminance value; a first filter for rendering the target data for one of the red or blue target subpixels of a corresponding one of the target pixels that corresponds to the one of the input pixels and has a first color by using the input data of said first color ones of the red or blue input subpixels that are near the one of the input pixels when the detected green light emitting pattern does not belong to the threshold pattern, and a second filter for rendering the target data for the one of the red or blue target subpixels by using the input data of the first color ones of the red or blue input subpixels that are near the one of the input pixels when the detected green light emitting pattern belongs to the threshold pattern.

The device may further include an input data buffer for storing as many lines of the input data as a number of rows of pixels in the pattern detecting window. Each of the lines of the input data may be for controlling light emission of the input pixels of one row in the RGB stripe configuration.

The threshold pattern may include a horizontal pattern in which at least two of the ones of the green subpixels that are contiguously arranged are arranged in a horizontal direction. The second filter may be configured to multiply the input data of a said first color one of the red or blue input subpixels of the one of the input pixels by a first filter variable to generate a first product, multiply the input data of a said first color one of the red or blue input subpixels of a neighboring top or bottom one of the input pixels of the one of the input pixels by a second filter variable to generate a second product, and add the first product and the second product.

A sum of the first filter variable and the second filter variable may be 1.

The threshold pattern may include a vertical pattern in which the at least two of the ones of the green subpixels that are contiguously arranged are arranged in a vertical direction. The second filter may be configured to multiply the input data of a said first color one of the red or blue input subpixels of the one of the input pixels by a first filter variable to generate a first product, multiply the input data of a said first color one of the red or blue input subpixels of a neighboring left or right one of the input pixels of the one of the input pixels by a second filter variable to generate a second product, and add the first product and the second product.

A sum of the first filter variable and the second filter variable may be 1.

According to yet another exemplary embodiment of the present invention, a device for rendering input data for controlling brightness of input pixels having an RGB stripe configuration and including green subpixels and red or blue input subpixels, into target data for target pixels having a pentile configuration and including red or blue target subpixels, is provided. The device includes: a pattern detector for applying a pattern detecting window with a predetermined size to the input data about one of the input pixels to detect a green light emitting pattern of ones of the green subpixels within the pattern detecting window, and determining whether the detected green light emitting pattern belongs to a threshold pattern in which at least two of the ones of the green subpixels that are contiguously arranged emit light exceeding a first luminance value; a first filter for rendering the target data for one of the red or blue target subpixels of a corresponding one of the target pixels that corresponds to the one of the input pixels and has a first color by using the input data of said first color ones of the red or blue input subpixels that are near the one of the input pixels when the detected green light emitting pattern does not belong to the threshold pattern, and a second filter for rendering the target data for the one of the red or blue target subpixels by using the input data of the first color ones of the red or blue input subpixels that are near the one of the input pixels when the detected green light emitting pattern belongs to the threshold pattern. The second filter may be configured to multiply the input data of a said first color one of the red or blue input subpixels of the one of the input pixels by a first filter variable to generate a first product, multiply the input data of a said first color one of the red or blue input subpixels of a neighboring top or bottom one of the input pixels of the one of the input pixels by a second filter variable to generate a second product, multiply the input data of a said first color one of the red or blue input subpixels of a neighboring left or right one of the input pixels of the one of the input pixels by a third filter variable to generate a third product, and add the first product, the second product, and the third product.

A sum of the first filter variable, the second filter variable, and the third filter variable may be 1.

The second filter may be further configured to multiply the input data of a said first color one of the red or blue input subpixels of a different neighboring one of the input pixels of the one of the input pixels by a fourth filter variable to generate a fourth product, and add the first product, the second product, the third product, and the fourth product.

A sum of the first to the fourth filter variables may be 1.

The second filter may be further configured to multiply the input data of a said first color one of the red or blue input subpixels of another different neighboring one of the input pixels of the one of the input pixels by a fifth filter variable to generate a fifth product, and add the first product, the second product, the third product, the fourth product, and the fifth product.

A sum of the first to the fifth filter variables may be 1.

The threshold pattern may include cross pattern in which the at least two of the ones of the green subpixels that are contiguously arranged are arranged to cross in a vertical direction and a horizontal direction.

According to still yet another exemplary embodiment of the present invention, a display device is provided. The display device includes: a pentile type of display panel including a plurality of gate lines for transmitting a plurality of gate signals, a plurality of data lines for transmitting a plurality of data voltages, and a plurality of subpixels respectively coupled to corresponding ones of the plurality of gate lines and corresponding ones of the plurality of data lines, a green subpixel and one of a red subpixel or a blue subpixel of the subpixels constituting a pixel; and a data driver for generating the plurality of data voltages. The plurality of data voltages are determined by target data corresponding to the plurality of subpixels. The target data are rendered from input data for controlling brightness of input pixels having an RGB stripe configuration by the device of any one of the above configurations.

According to aspects of embodiments of the present invention, readability and resolution of pentile displays driven with RGB stripe input data can be improved when precise patterns or characters are expressed in the pentile pixel configuration having red or blue subpixels as members in each pixel.

BRIEF DESCRIPTION OF THE DRAWINGS

FIG. 6 shows a diamond filter according to an exemplary embodiment of the present invention.

FIG. 7 shows a diamond-sharpening filter according to an exemplary embodiment of the present invention.

FIG. 8 shows a vertical spread filter according to an exemplary embodiment of the present invention.

FIG. 9 shows a horizontal spread filter according to an exemplary embodiment of the present invention.

FIG. 10 shows a horizontal/vertical spread filter according to an exemplary embodiment of the present invention.

FIG. 11 shows an exemplary variation of the horizontal/vertical spread filter of FIG. 10 according to an embodiment of the present invention.

DETAILED DESCRIPTION

Figure 1:
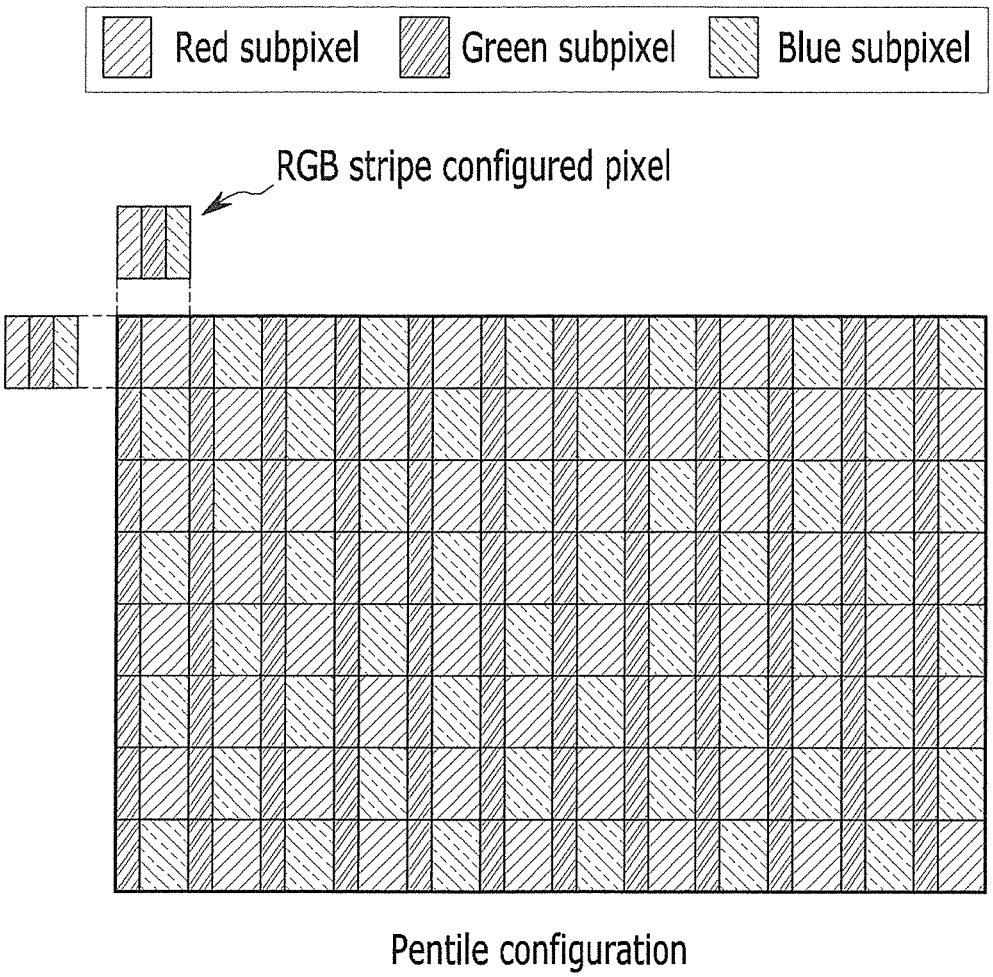
FIG. 1 is a schematic diagram of an example of the pentile configuration.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Throughout this specification and the claims that follow, when it is described that an element is "coupled" to another element, the element may be "directly coupled" (for example, connected) to the other element or indirectly coupled (for example, "electrically coupled" or electrically connected) to the other element through one or more third elements. In addition, unless explicitly described to the contrary, the word "comprise" and variations such as "comprises" or "comprising" will be understood to imply the inclusion of stated elements but not the exclusion of any other elements.

Exemplary embodiments of the present invention will now be described in detail with reference to accompanying drawings. These embodiments relate to rendering input data suitable for driving one display device (a first display device) into target data suitable for driving another display device (a second display device). As a non-limiting example, these embodiments will be described from the perspective of the first display device being an RGB stripe-type display device and the second display device being a pentile type display device having a pentile pixel configuration similar to that of FIG. 1.

A size and a method of a filter for rendering the data for respective color channels can be appropriately designed according to the pentile configuration. The goal of such a rendering is to match a pattern that is displayed as an image of an RGB stripe display panel with the same resolution and appearance when displayed on a display panel that is realized with the pentile configuration. For this purpose, a filtering method for expressing thin lines with a thickness of a single pixel (i.e., a pixel of the RGB stripe) in a sharp manner may be used.

Figure 2A:
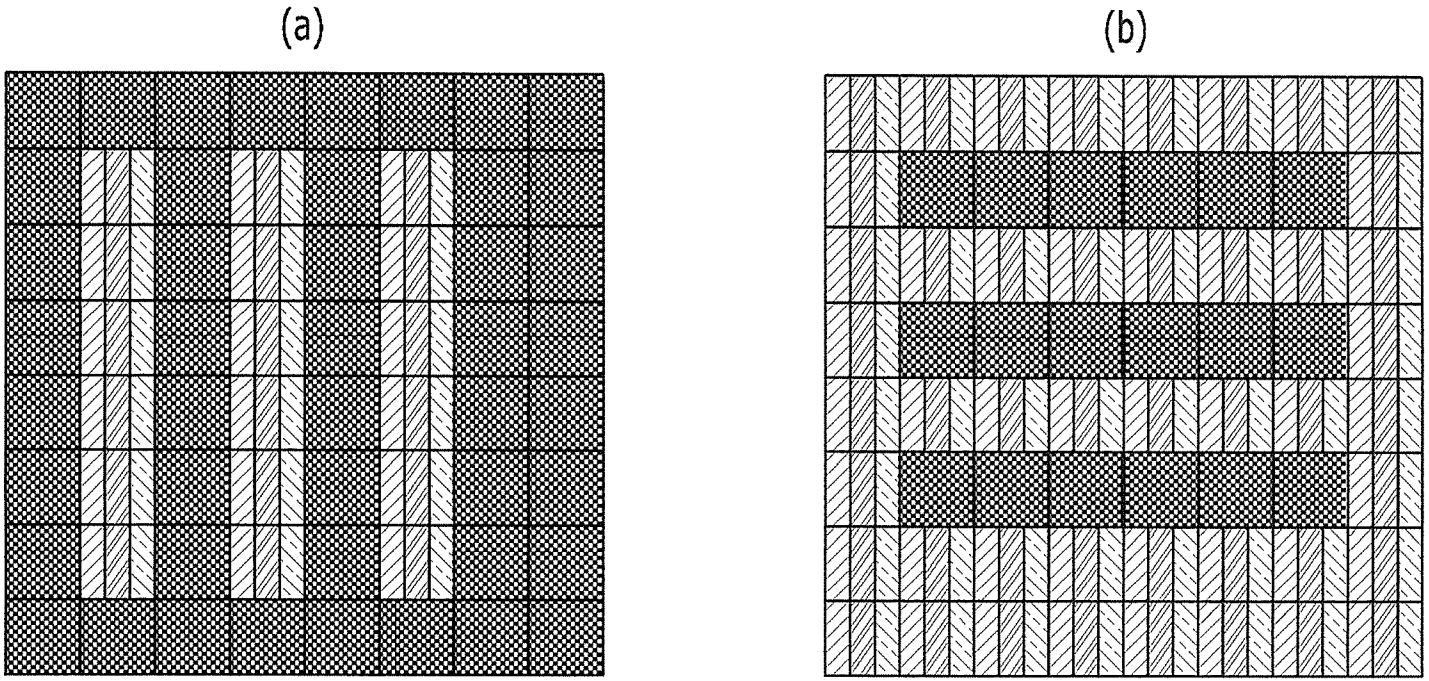
FIG. 2A shows a display panel according to an RGB stripe configuration when specific patterns are displayed.
Figure 2B:
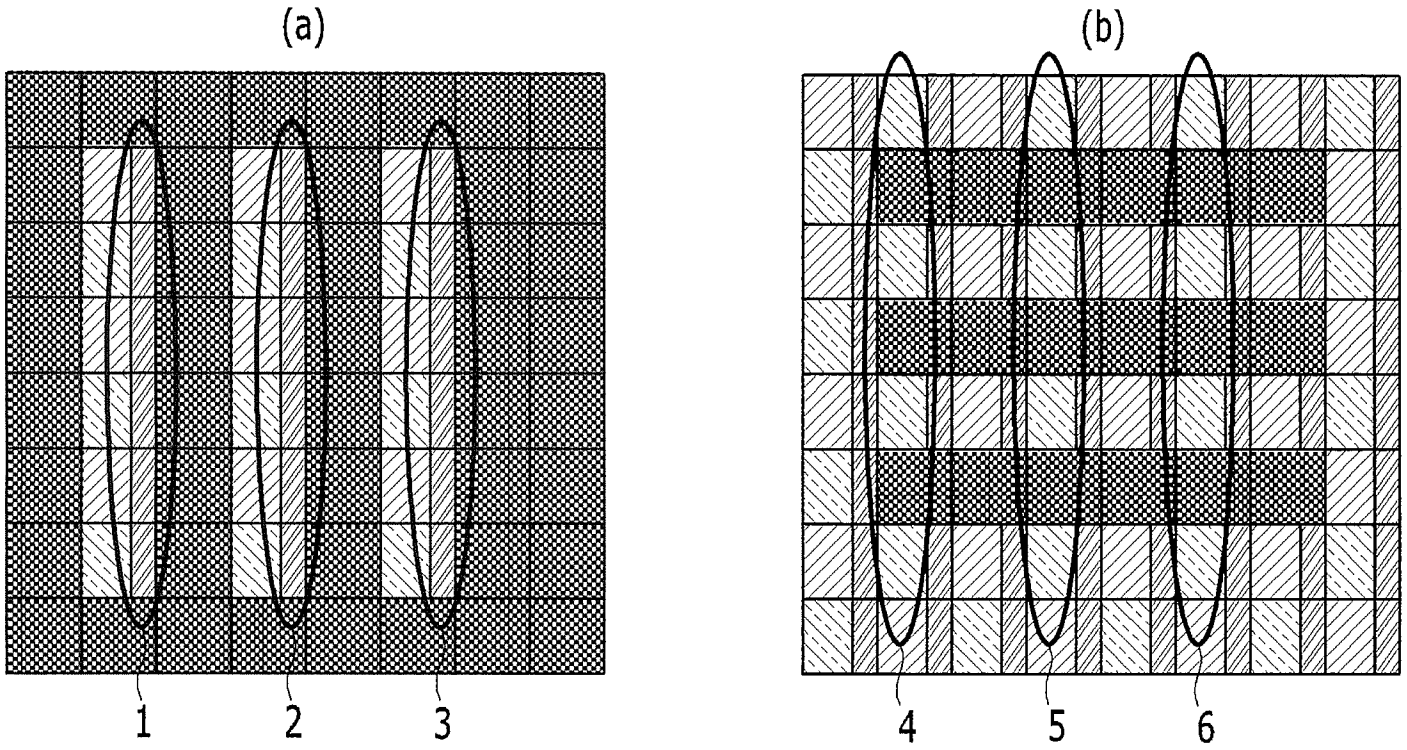
FIG. 2B shows a comparable display panel according to a pentile configuration when the specific patterns of FIG. 2A are displayed.

FIG. 2A shows a display panel according to an RGB stripe configuration when specific patterns are displayed. FIG. 2B shows a comparable display panel according to a pentile configuration when the specific patterns of FIG. 2A are displayed.

For example, the specific pattern may be a white line pattern in which vertical white lines of one (RGB) pixel in width are repeated on a black background with one pixel (i.e., the pixel of the RGB stripe) of black background between each white line, as illustrated for an RGB configuration in FIG. 2A(a). The same pattern for a pentile display may be rendered to appear as in FIG. 2B(a). Another specific pattern may be a black line pattern in which horizontal black lines of one pixel in width are repeated on a white background with one pixel of white background between each black line, as illustrated for an RGB configuration in FIG. 2A(b). The same pattern for a pentile display may be rendered to appear as in FIG. 2B(b).

In FIGS. 2A-2B, black is expressed as dark gray pixels while white is expressed as patterned subpixels within each pixel. When the subpixels emit light in a pentile configuration shown in FIG. 2B using rendered data for controlling light emission of the red, green, and blue subpixels, visibility problems may occur. These are described and illustrated in further detail with reference to FIGS. 3A-3B.

Figure 3A:
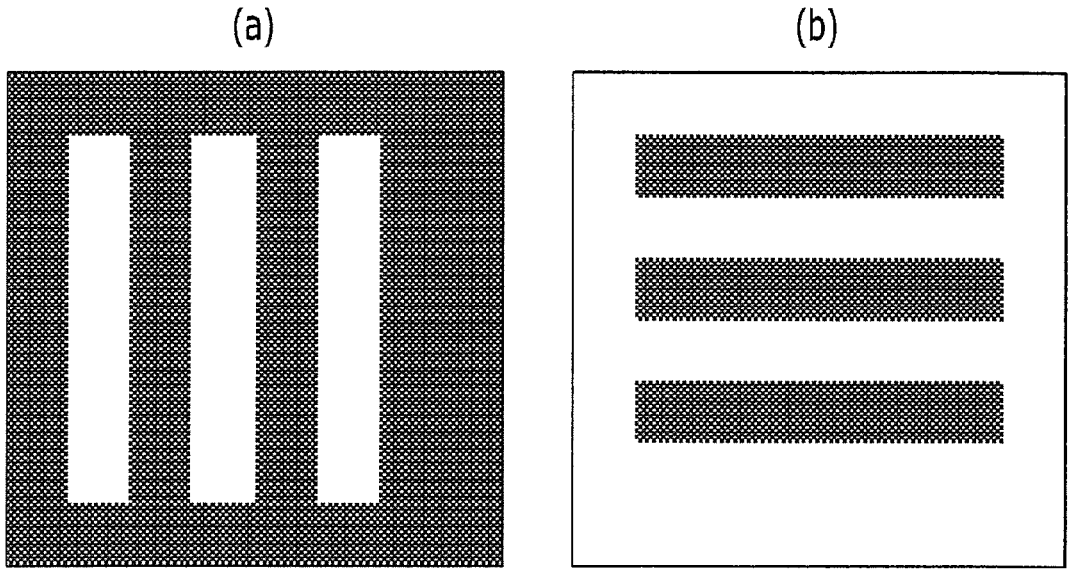
FIG. 3A illustrates how the specific patterns of FIG. 2A may appear on an RGB display panel.
Figure 3B:
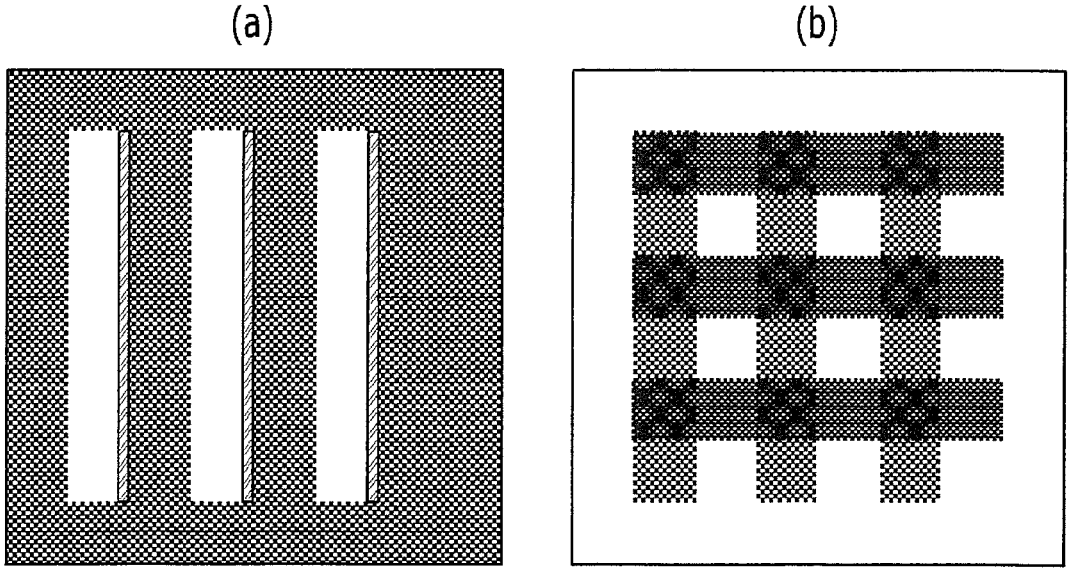
FIG. 3B shows how these same specific patterns may appear on a comparable pentile-type display panel after rendering the RGB data used to create the patterns of FIG. 3A.

FIG. 3A illustrates how the specific patterns of FIG. 2A may appear on an RGB display panel. FIG. 3B shows how these same specific patterns may appear on a comparable pentile-type display panel after rendering the RGB data used to create the patterns of FIG. 3A. Black is expressed as dark gray in FIGS. 3A-3B.

Two phenomena can be observed in FIG. 3B that are not part of FIG. 3A, even though both figures illustrate displays having similar resolutions that are displaying what should be the same images. In FIG. 3B(a), for the white vertical lines on the black background, the right outer part of the white vertical lines can be visible as greenish, as opposed to FIG. 3A(a), where the vertical white lines appear to be white. This is caused by the difference in the layout of the green subpixels in the two displays. In an RGB display, like what generated FIG. 3A(a), the green subpixels are between red and blue subpixels having similar intensities (thus concealing the green), whereas in a pentile display, like what generated FIG. 3B(a), the green subpixels are between red and blue subpixels having contrasting intensities (e.g., one bright, one dark, thus highlighting the green). That is, as shown in FIG. 2B(a), when white vertical lines are displayed on the black background, the green subpixels with the greatest luminance are on the outer part of the white lines, as shown with 1, 2, and 3, making the green visible by itself.

Meanwhile, in FIG. 3B(b), for the black horizontal lines on the white background, dark vertical lines appear adjacent to the black lines, creating what is viewed as a lattice pattern. This is caused by the difference in the layout of the red and blue subpixels in the two displays. In the RGB display, like what generated FIG. 3A(b), there are red and blue subpixels in each pixel, of similar size to the green subpixels. This allows white to be generated for each pixel.

By contrast, in the pentile display, like what generated FIG. 3B(b), the red and blue subpixels appear in every other pixel, and they are twice as large as the green subpixels. Accordingly, to adequately display the equivalent amount of red and blue in the pentile display, adjacent red and blue subpixels have to have their intensity increased or decreased to compensate for not being able to increase or decrease the intensity of the red and blue subpixels in every pixel. This causes the red and blue subpixels to be turned on with some intensity in the black lines, and to have some of their intensity diminished in the white lines. Given the larger subpixel size and that blue subpixels appear to be darker than red or green when connected in series as shown with 4, 5, and 6 in FIG. 2B(b), vertical patterns of the blue subpixels appear darker in the white background than the neighboring red and green subpixels, which leads to the lattice effect.

To address discrepancies like this between the two types of displays, a data rendering device according to an exemplary embodiment of the present invention uses RGB input data of pixels belonging to a pattern detecting window to detect a light emitting pattern of a green subpixel, and selects one of a first filter or a second filter according to a detected light emitting pattern to render the data. The pattern detecting window is set to have a set size (for example, a predetermined size) for detecting the green light emitting pattern.

The data rendering device uses a second filter to spread light emission of the red (or blue) subpixel that is near the green subpixel when the detected light emitting pattern is a threshold pattern, and it uses a first filter for the pentile configuration when the detected light emitting pattern is not the threshold pattern (hereinafter, a normal pattern). The first filter for the pentile configuration represents a filter that is formed for displaying an image on the pentile configuration in a like manner of an image on the RGB stripe configuration. Example first filters will be described later with reference to FIGS. 6-7. An example threshold pattern will be described later with reference to FIG. 5.

Data for controlling light emission of the respective subpixels in the RGB stripe configuration will be called input data, while data for controlling light emission of the respective subpixels in the pentile configuration will be referred to as rendered data or target data. That is, when detecting the threshold pattern, the data rendering device uses the second filter to filter the input data of the red subpixel (or blue subpixel) that is part of the threshold pattern (e.g., in the middle of the threshold pattern) and the red input data of another pixel that is near this red subpixel (or blue subpixel) to generate target data of the red subpixel (or blue subpixel) that is part of the threshold pattern.

Figure 4:
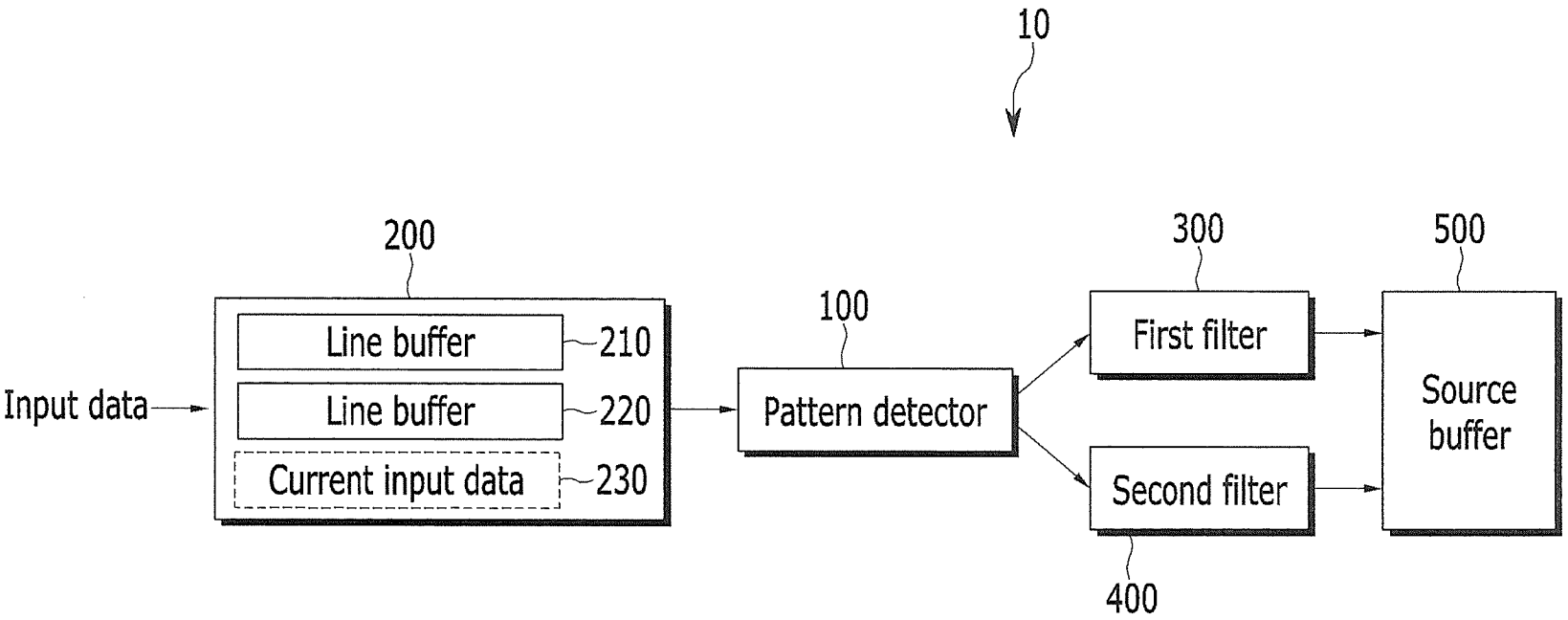
FIG. 4 is a block diagram illustrating a data rendering device according to an exemplary embodiment of the present invention.

A data rendering device according to an exemplary embodiment of the present invention will now be described with reference to FIG. 4. FIG. 4 is a block diagram illustrating a data rendering device 10 according to an exemplary embodiment of the present invention.

As shown in FIG. 4, the data rendering device 10 includes a pattern detector 100, an input data buffer 200, a first filter 300, a second filter 400, and a source buffer 500. The pattern detector 100, when rendering the RGB input data for the pentile-type subpixel, analyzes the input data for controlling brightness of a plurality of RGB pixels included in the pattern detecting window that is provided with respect to a target pixel including a target subpixel. The target subpixel signifies a subpixel to which rendered data will be applied, and the target pixel represents a pentile-type pixel including the target subpixel. The input data corresponding to the pattern detecting window represent input data for controlling brightness of a plurality of pixels in the RGB stripe configuration belonging to the pattern detecting window.

In the pentile configuration, the target data of the green subpixel can be equivalent to the input data. As shown in FIG. 1, the green subpixel of the pixel based on the pentile configuration and the green subpixel based on the RGB stripe configuration have different positions within each pixel (that is, the green subpixels appear in the middle of the RGB pixels, but are at one of the sides in the pentile pixels), though they are set to have the same size. Therefore, the input data for controlling light emission of the green subpixels of the RGB stripe configuration can be used for the target data for controlling light emission of the green subpixels of the pentile configuration.

When there are input data for emitting at least two green subpixels that are contiguously arranged according to the input data analysis result, the pattern detector 100 detects a light emitting pattern of the green subpixel and determines whether the detected pattern is a threshold pattern. The threshold pattern includes patterns generating problems such as the above-noted visibility problems (e.g., vertical white lines on black background, or horizontal black lines on white background) and it can have various patterns according to factors such as the pentile configuration, the pattern detecting window size, etc.

Figure 5:
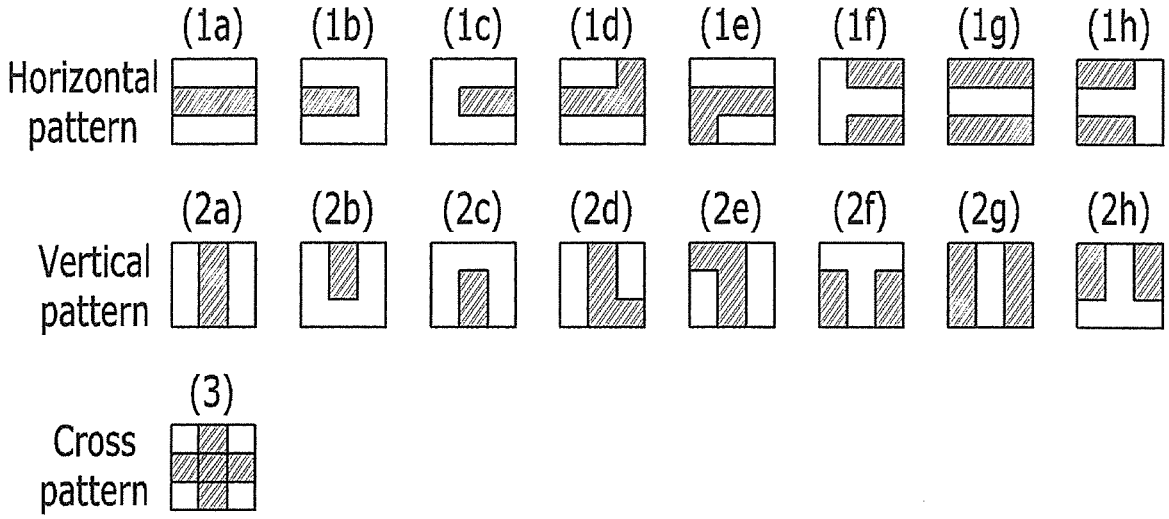
FIG. 5 shows various patterns belonging to a predetermined threshold pattern according to an exemplary embodiment of the present invention.

FIG. 5 shows various patterns (each of size 3 pixels by 3 pixels) belonging to a predetermined threshold pattern according to an exemplary embodiment of the present invention. In further detail, FIG. 5 shows examples of the threshold pattern for the pentile configuration in which one pixel includes one green subpixel and one of the red or blue subpixels.

As shown in FIG. 5, the threshold pattern includes eight horizontal patterns (labeled 1*a* through 1*h*), eight vertical patterns (labeled 2*a* through 2*h*), and a cross pattern 3. In each pattern, the striped portions represent pixels whose corresponding green subpixels are emitting light (or sufficient light), while the plain portions represent pixels whose corresponding green subpixels are not emitting light (or sufficient light).

When the detected green light emitting pattern is a threshold pattern, the pattern detector 100 transmits a filter type following the detected green light emitting pattern and input data included in the pattern detecting window to the second filter 400. When there are no input data for emitting the contiguously arranged green subpixels or the detected green light emitting pattern is not the threshold pattern, the pattern detector 100 transmits the input data included in the pattern detecting window to the first filter 300.

Referring back to FIG. 4, the input data buffer 200 stores, per line, the input data that are as many as the number of lines used for detecting the threshold pattern. When the size of the pattern detecting window is set, the size of the window is considered and the number of line buffers included in the input data buffer 200 is established. The term "per line" represents a set of a plurality of input data for controlling light emission of the pixels on one row in the RGB stripe configuration.

For example, when the size of the pattern detecting window is 3×3, the input data buffer 200 includes at least two line buffers 210 and 220 (holding previous lines of input data) in addition to a current input data line buffer 230. The input data belonging to the 3×3 pattern detecting window with reference to the target pixel include the input data that are stored in the line buffers 210 and 220, and the input data (i.e., current input data line buffer) 230 that are currently input.

The first filter 300 filters the input data with the same color as the target subpixel from among the input data that are included in the pattern detecting window provided by the pattern detector 100 to generate the target data of the target subpixel. In this instance, the first filter 300 can be formed so that the image of the pentile configuration may be similar to the image of the RGB stripe configuration.

Example first filters 300 will now be described with reference to FIGS. 6-7. For better understanding and ease of description, the pixel of the RGB stripe configuration will be referred to as a pixel, while the pentile-type pixel will be called a pentile pixel.

FIG. 6 shows a diamond filter according to an exemplary embodiment of the present invention. FIG. 7 shows a diamond-sharpening filter according to an exemplary embodiment of the present invention.

For example, the first filter 300 can be formed to be a diamond filter shown in FIG. 6 or a diamond-sharpening filter shown in FIG. 7. Since the size of the pattern detecting window is 3×3 pixels, the filters shown in FIG. 6 and FIG. 7 are shown to have the size of 3×3. Each 3×3 pattern detecting window corresponds to a target pixel, specifically the target pixel corresponding to the center pixel in the 3×3 window.

When the first filter 300 is realized by the diamond filter shown in FIG. 6, the first filter 300 multiplies respective input data for controlling brightness of the subpixels having the same color as the target subpixels belonging to the target pixel from among the nine pixels included in the pattern detecting window (that is, the center pixel), and the pixels that are on the right, left, top, and bottom of the target pixel, by a corresponding filter variable a or b to generate the target data. For example, when the target subpixel is a red subpixel, the first filter 300 multiples the respective input data of the red subpixels belonging to the target pixel, and the pixels that are on the right, left, top, and bottom of the target pixel, by the corresponding filter variable a or b to generate the target data.

In this instance, as shown in FIG. 6, the filter variables a and b can be set to have values that satisfy the equation $a+4b=1$. That is, the filter variables a and b can be chosen to generate target data equivalent to a weighted average of the respective input data for the target subpixel and its neighboring subpixels of the same color.

Next, when the first filter 300 is realized with the diamond-sharpening filter shown in FIG. 7, the first filter 300 multiplies the respective input data of the subpixels having the same color as the target subpixel belonging to the nine pixels included in the pattern detecting window by the corresponding filter variable from among a, b, and c to generate the target data. For example, when the target subpixel is a red subpixel, the first filter 300 multiples the respective input data of the red subpixels belonging to the nine pixels included in the pattern detecting window by the corresponding filter variable a, b, or c to generate the target data.

In this instance, as shown in FIG. 7, the filter variable a, b, and c can be set to have values that satisfy the equation $a+4b-4c=1$. This, too, represents a weighted average of the respective input data for the target subpixel and its neighboring subpixels of the same color.

The second filter 400 filters the input data with the same color as the target subpixel from among the input data included in the pattern detecting window provided by the pattern detector 100 by using a filtering method that follows the detected threshold pattern to thus generate the target data of the target subpixel. Example second filters 400 will now be described with reference to FIGS. 8-11.

FIG. 8 shows a vertical spread filter according to an exemplary embodiment of the present invention. FIG. 9 shows a horizontal spread filter according to an exemplary embodiment of the present invention. FIG. 10 shows a horizontal/vertical spread filter according to an exemplary embodiment of the present invention. FIG. 11 shows an exemplary variation of the horizontal/vertical spread filter of FIG. 10 according to an embodiment of the present invention.

The second filter 400 includes, for example, a vertical spread filter, a horizontal spread filter, and a horizontal/vertical spread filter. The second filter 400 selects one of the three filters according to the pattern detected by the pattern detector 100, and filters the input data with the same color as the target subpixel from among the input data included in the pattern detecting window provided by the pattern detector 100 to generate the target data of the target subpixel.

When the vertical spread filter shown in FIG. 8 is selected, the second filter 400 multiplies (first) input data for controlling brightness of the target subpixel, and (second) input data for controlling brightness of the subpixel with the same color as the target subpixel at the (first) pixel that is on top of the target pixel by the corresponding filter variable a or b, respectively, and adds the two products to generate the target data.

In this instance, as shown in FIG. 8, the filter variables a and b can be set to have values that satisfy the condition of a+b=1, thus producing a weighted average of the respective input data for the target subpixel and its neighboring upper subpixel of the same color. For example, the filter variables a and b can each be set to 0.5. In FIG. 8, the input data for controlling the brightness of the target subpixel comes from the pixel on top of the target pixel, but the present invention is not restricted thereto, and the input data from the pixel on the bottom of the target pixel can be used in place of, or in addition to, the top pixel in other embodiments.

When the horizontal spread filter shown in FIG. 9 is selected, the second filter 400 multiplies the (first) input data for controlling brightness of the target subpixel, and (third) input data for controlling brightness of the subpixel with the same color as the target subpixel at the (second) pixel that is to the left of the target pixel by the corresponding filter variable a or b, respectively, and adds the two products to generate the target data.

In this instance, as shown in FIG. 9, the filter variables a and b can be set to have values that satisfy the equation a+b=1, as with the vertical spread filter of FIG. 8. For example, the filter variables a and b can each be set to 0.5.

In FIG. 9, the input data for controlling the brightness of the target subpixel comes from the pixel on the left of the target pixel, but the present invention is not restricted thereto, and the input data from the pixel on the right thereof can be used in place of, or in addition to, the left pixel in other embodiments.

When the vertical/horizontal spread filter shown in FIG. 10 is selected, the second filter 400 multiplies the (first) input data for controlling brightness of the target subpixel, the (second) input data for controlling brightness of the subpixel having the same color as the target subpixel at the (first) pixel that is on top of the target pixel, and the (third) input data for controlling brightness of the subpixel having the same color as the target subpixel at the (second) pixel that is on the left side of the target pixel by the corresponding filter variable a, b, or c, and adds the three products to generate the target data.

In this instance, as shown in FIG. 10, the filter variables a, b, and c can be set to satisfy the equation a+b+c=1, in a similar fashion to the vertical spread filter and horizontal spread filter of FIGS. 8-9. For example, a can be set to 0.5, and b and c can each be set to 0.25.

In FIG. 10, the input data for controlling the brightness of the target subpixel comes from the pixels on the left and top of the target pixel, but the present invention is not restricted thereto, and the input data from the pixel on the right and/or the bottom thereof can be used in place of, or in addition to, the left and top pixels in other embodiments.

When the second filter 400 includes a vertical/horizontal spread filter shown in FIG. 11 other than a vertical/horizontal spread filter like that shown in FIG. 10, and the vertical/horizontal spread filter shown in FIG. 11 is selected, the second filter 400 multiplies the (first) input data for controlling brightness of the target subpixel and the (second to the fifth) input data for controlling brightness of the subpixels with the same color as the target subpixel from the pixels that are on the top, bottom, right, and left of the target pixel by the corresponding filter variable a or b, and adds the five products to generate the target data.

In this instance, as shown in FIG. 11, the filter variables a and b can be set to satisfy the equation a+4b=1, in a similar fashion to the vertical spread filter, horizontal spread filter, and vertical/horizontal spread filter of FIGS. 8-10. For example, a can be set to 0.5, and b can be set to 0.125. The input data of the subpixels having the same color on the top, bottom, right, and left of the target pixel are multiplied by the same filter variable b in FIG. 11, but the present invention is not restricted thereto, and other values can also be used for the variable. In this case, the sum of the filter variables is 1.

FIG. 11 shows the same pattern as the diamond filter shown in FIG. 6. Nevertheless, the values of a and b can be set to different values than the diamond filter. In addition, FIG. 11 shows an example of the horizontal/vertical spread filter, with the filter variable b corresponding to the input data of the pixels on the right and the left of the target pixel and the pixels on the top and the bottom of the target pixel, but the present invention is not limited thereto. In other embodiments, three of these pixels may be chosen, such as the pixels on the top and bottom of the target pixel and one of the subpixels with the same color on the left (or the right) of the target pixel can be multiplied. In this instance, the equation a+3b=1 is satisfied.

The vertical spread filter, the horizontal spread filter, and the vertical/horizontal spread filter that are described with reference to FIG. 8 to FIG. 11 are exemplary embodiments of the present invention, but the present invention is not limited thereto. For example, in a different embodiment, another vertical spread filter may use the pixels on the top and bottom of the target pixel, satisfying the equation a+2b=1. The variables of the filter can be set, for example, such that green is not visible on the white vertical lines on the black background, and that the black horizontal lines on the white background are not visible as a lattice.

When the detected light emitting pattern is one of the horizontal patterns 1*a*-1*h* shown in FIG. 5, the second filter 400 selects the vertical spread filter, and when it is one of the vertical patterns 2*a*-2*h*, the second filter 400 selects the horizontal spread filter. Further, when the detected light emitting pattern is the cross pattern 3 shown in FIG. 5, the second filter 400 selects the vertical/horizontal spread filter.

However, the present invention is not restricted thereto, and the vertical/horizontal spread filter shown in FIG. 10 and FIG. 11 can be used irrespective of the vertical pattern, the horizontal pattern, and the cross pattern. That is, the spread filter selected by the second filter 400 according to the detected light emitting pattern should be chosen to correct distortion of the image that is visible by the detected light emitting pattern.

Referring back to FIG. 4, the data rendered through the first filter 300 and the second filter 400 are stored in an address that corresponds to the source buffer 500. The rendered data in the source buffer 500 may then be used to drive a pentile-type display.

A method for generating rendered data according to an exemplary embodiment of the present invention will now be described and shown in more detail with reference to FIG. 12 to FIG. 20. The vertical pattern, an example of the threshold pattern, will now be described. For example, a vertical pattern having white vertical lines on a black background will first be described with reference to FIGS. 12-14.

Figure 12:
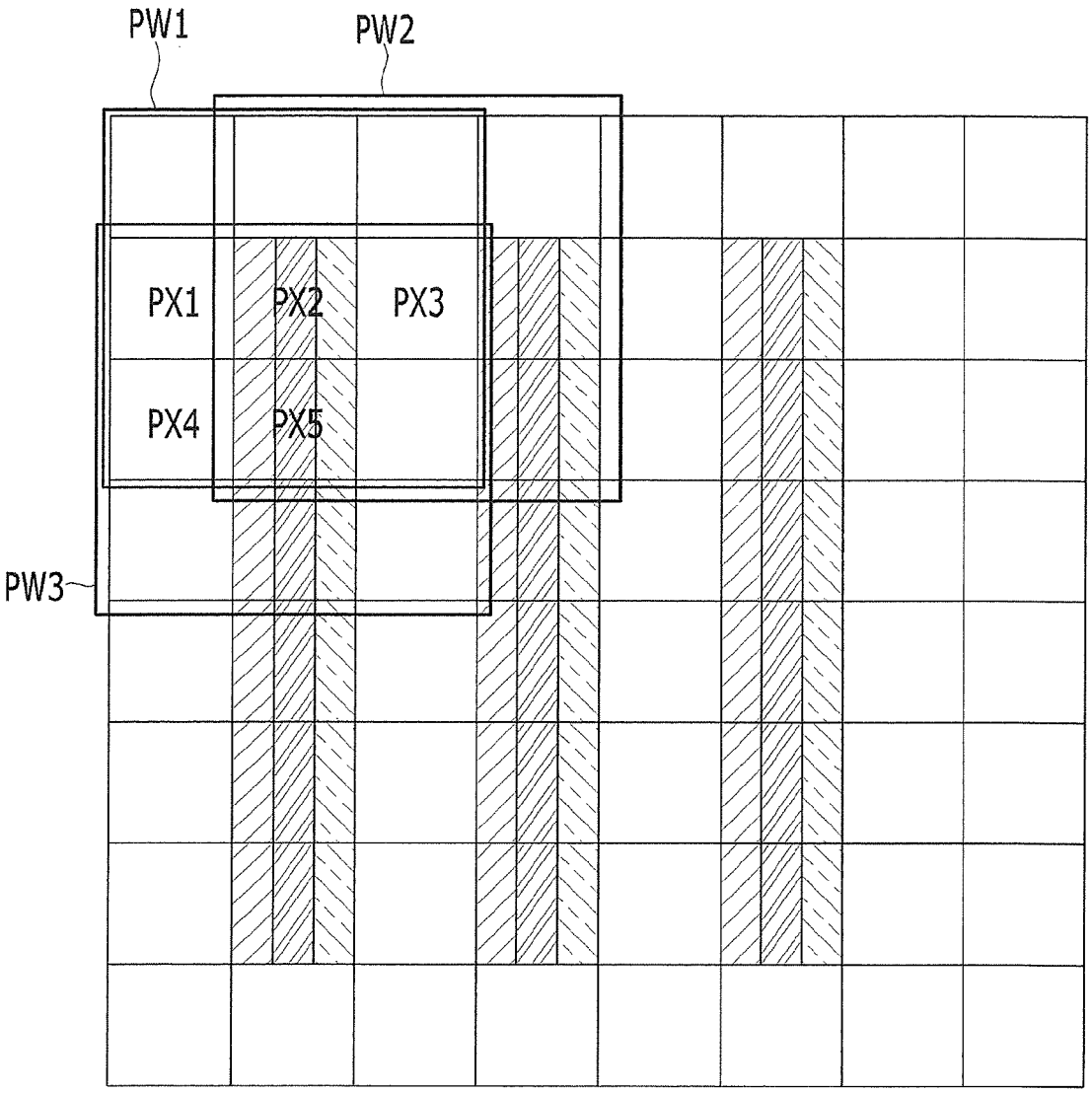
FIG. 12 shows a display pattern of an RGB stripe configuration when RGB stripe-type pixels display a vertical pattern.

FIG. 12 shows a display pattern of an RGB stripe configuration when RGB stripe-type pixels display a vertical pattern.

As shown in FIG. 12, RGB subpixels (that is, the shaded subpixels) of the pixels for displaying the three white vertical lines emit light. The unshaded pixels in FIG. 12 represent the pixels that do not emit light (that is, form the black background), or emit relatively little (or less) light than neighboring pixels. This is true for the other figures as well, that is, the unshaded pixels or subpixels indicate the pixels or subpixels that do not emit light (or emit relatively little light compared to neighboring pixels) in FIG. 12 to FIG. 20.

Figure 13:
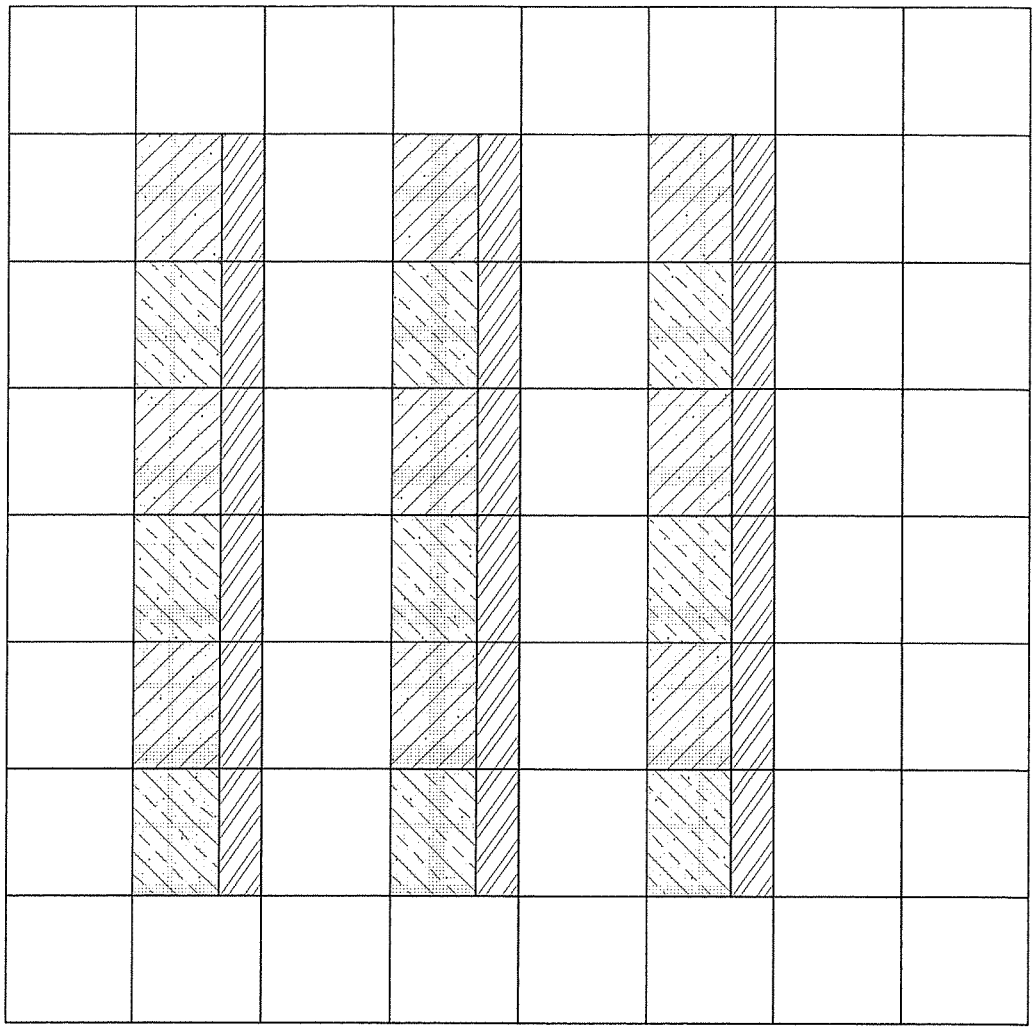
FIG. 13 shows a pentile type of display pattern when pentile-type pixels display the vertical pattern of FIG. 12 according to data that are rendered by using a diamond filter (or a diamond-sharpening filter).

FIG. 13 shows a pentile type of display pattern when pentile-type pixels display the vertical pattern of FIG. 12 according to data that are rendered by using a diamond filter (or a diamond-sharpening filter).

As shown in FIG. 13, the red subpixels and the green subpixels (or the blue subpixels and the green subpixels) of the pixels for displaying the white vertical lines emit light. When the green subpixels that are arranged in a line in a vertical direction emit light in FIG. 13 (that is, the green subpixels of the vertical white lines), it can be viewed as a greenish white line. This is due to the luminance difference between the relatively strong red (or blue) subpixels to the left of these green subpixels and the relatively weak corresponding blue (or red) subpixels to the right of these green subpixels. See also FIG. 2B(a) and FIG. 3B(a).

Figure 14:
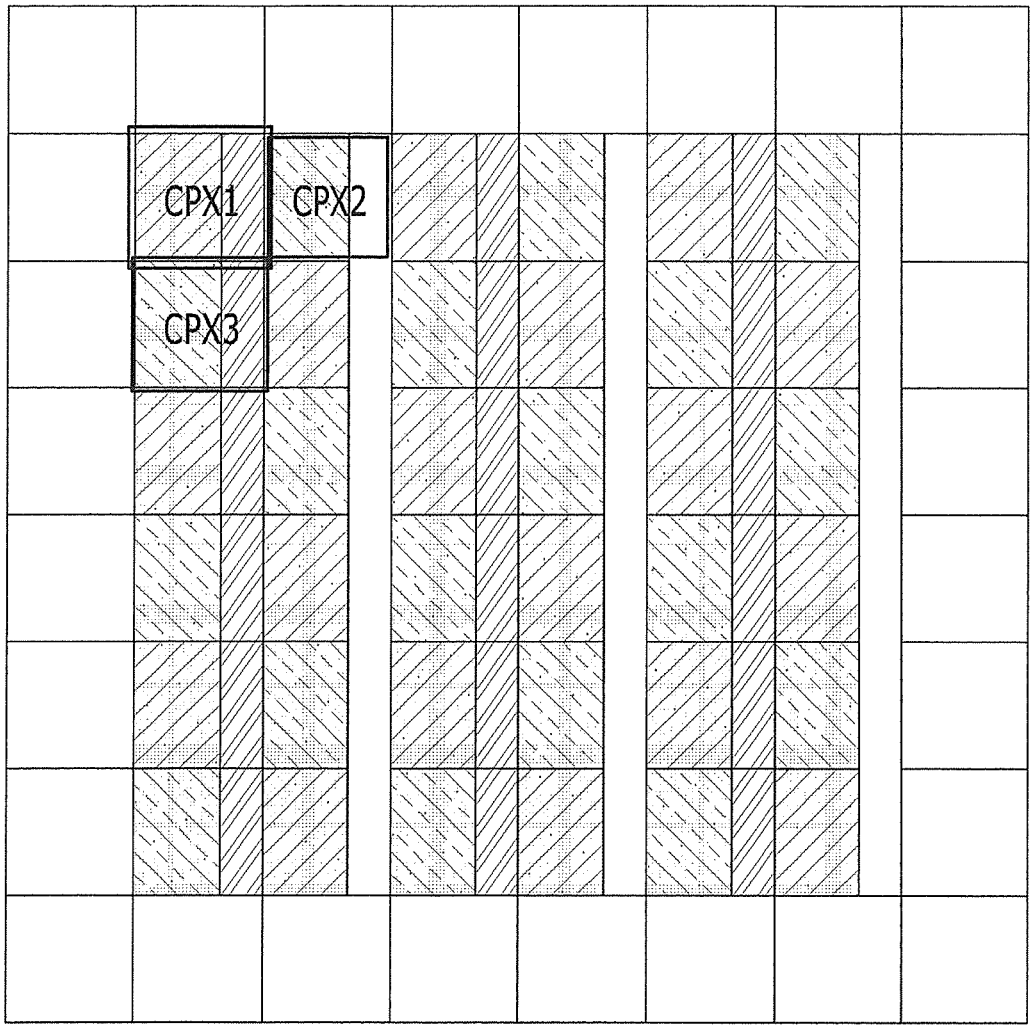
FIG. 14 shows a pentile type of display pattern when pentile-type pixels display the vertical pattern of FIG. 12 according to rendered data using a data rendering method according to an exemplary embodiment of the present invention.

FIG. 14 shows a pentile type of display pattern when pentile-type pixels display the vertical pattern of FIG. 12 according to rendered data using a data rendering method according to an exemplary embodiment of the present invention.

As shown in FIG. 14, the red subpixels and the blue subpixels on both sides of the green subpixels emit light with a set brightness (for example, a predetermined brightness). That is, these red and blue subpixels have much closer luminance than in FIG. 13, thus reducing or eliminating the greenish effect observed in FIG. 13.

In further detail, FIG. 12 shows three 3×3 pattern detecting windows PW1, PW2, and PW3, centered at (RGB) pixels PX2, PX3, and PX5, respectively. These respectively correspond to target (pentile) pixels CPX1, CPX2, and CPX3 of FIG. 14. When the input data of the pattern detecting window PW1 shown in FIG. 12 are analyzed, a third threshold pattern, that is, pattern 2*c*, is detected from the vertical patterns shown in FIG. 5. As a result, the second filter 400 horizontally spreads (using the horizontal spread filter of FIG. 9) red input data of a target pixel CPX1 using pixels PX1 and PX2 corresponding to the target pixel CPX1 and the pixel to the left of the target pixel CPX1 to generate the target data of the red subpixel of the target pixel CPX1.

When the input data of a pattern detecting window PW2 that is acquired by shifting the pattern detecting window PW1 by one pixel to the right are analyzed, a sixth threshold pattern, that is, pattern 2*f*, is detected from the vertical patterns shown in FIG. 5. As a result, the second filter 400 horizontally spreads the blue input data of a target pixel CPX2 using pixels PX2 and PX3 corresponding to the target pixel CPX2 and the pixel to the left of the target pixel CPX2 to generate the target data of the blue subpixel of the target pixel CPX2.

When the input data for one line of pixels are rendered as described above, the input data for the next line of pixels are rendered in a like manner. For instance, when the input data of a pattern detecting window PW3 that is acquired by moving the pattern detecting window PW1 down one pixel to the next line of pixels are analyzed, the first threshold pattern, that is, pattern 2*a*, is detected from the vertical patterns shown in FIG. 5. As a result, the second filter 400 horizontally spreads the blue input data of a target pixel CPX3 using pixels PX4 and PX5 corresponding to the target pixel CPX3 and the pixel to the left of the target pixel CPX3 to generate the target data of the blue subpixel of the target pixel CPX3.

Continuing in this fashion, when the vertical patterns are detected as described above, the white lines on the black background are displayed according to the horizontal spread pattern shown in FIG. 14 though horizontal spreading. Consequently, luminance differences of the red and blue subpixels on both sides of the green subpixels emitting light shown in FIG. 14 are reduced compared to the luminance differences of the corresponding red and blue subpixels shown in FIG. 13 through horizontal spreading. A similar reduction in the luminance differences of the nearby red and blue subpixels takes place through vertical spreading and horizontal/vertical spreading, as will be shown with reference to FIGS. 15-20.

The horizontal pattern, another example of the threshold pattern, will now be described. For example, a horizontal pattern for displaying black horizontal lines on a white background will next be described with reference to FIGS. 15-17.

Figure 15:
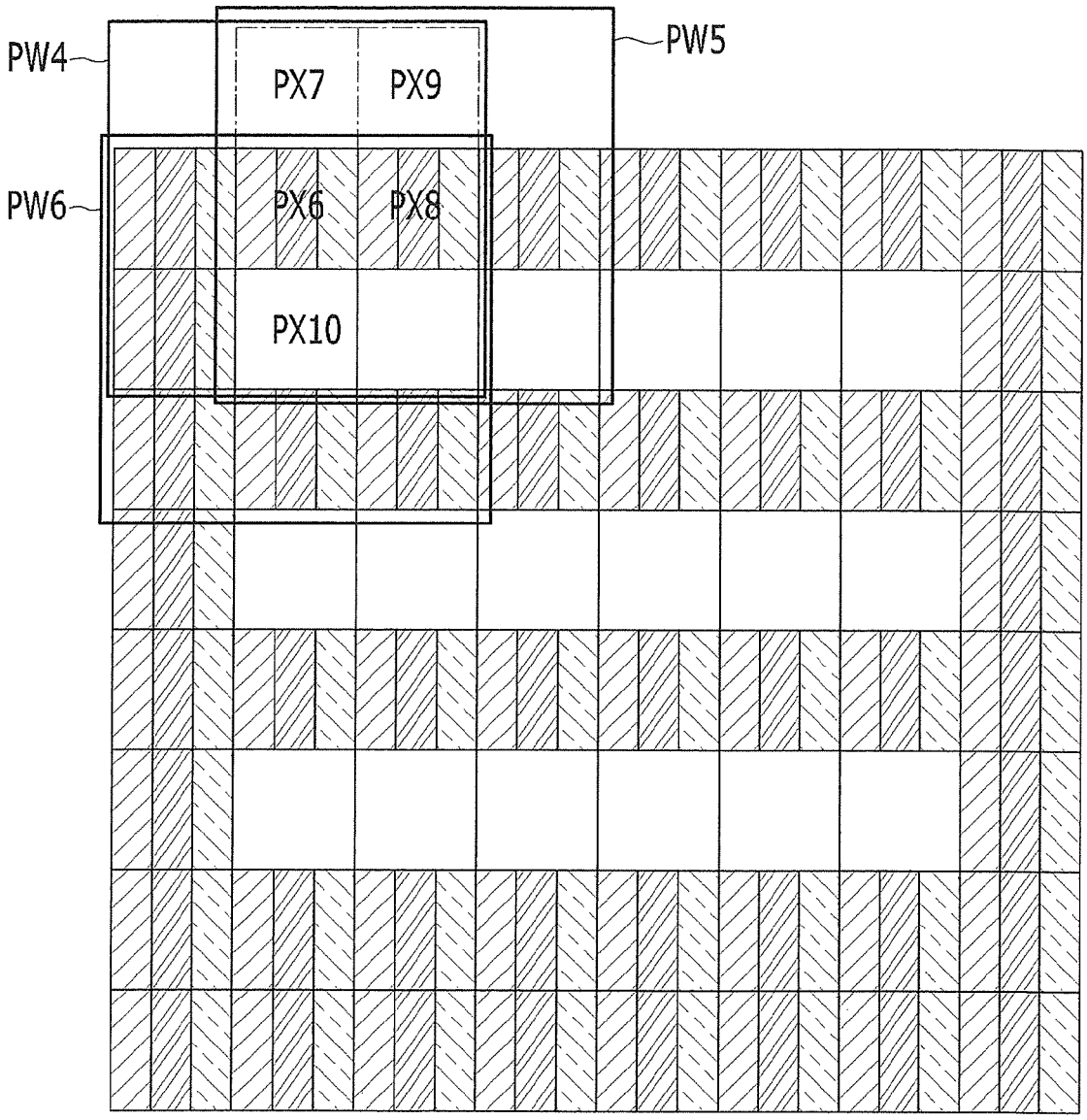
FIG. 15 shows an RGB stripe type of display pattern when RGB stripe-type pixels display a horizontal pattern.

FIG. 15 shows an RGB stripe type of display pattern when RGB stripe-type pixels display a horizontal pattern.

As shown in FIG. 15, the RGB subpixels (that is, the shaded subpixels) of the pixels for displaying the white background emit light. The unshaded pixels for indicating the black (or darker) color pixels horizontal lines do not emit light, or emit relatively little light than neighboring pixels.

Figure 16:
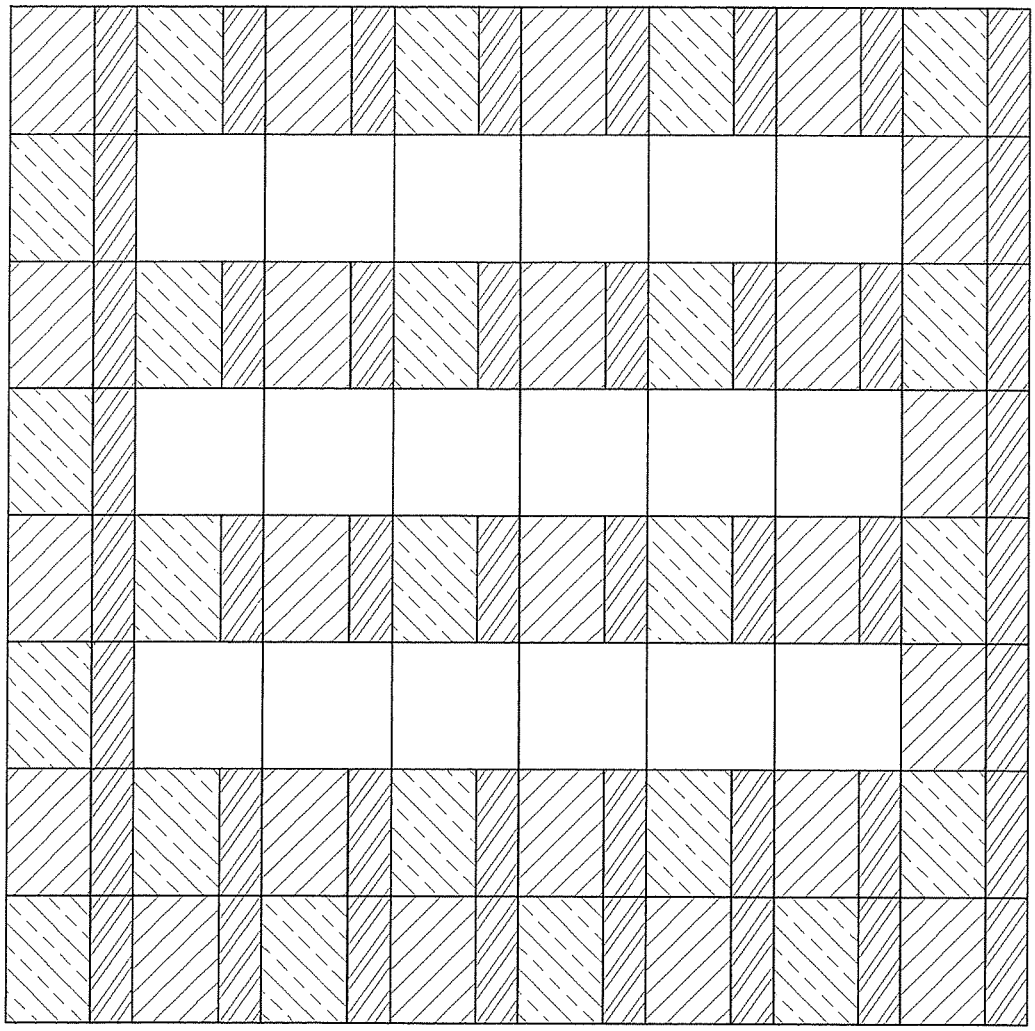
FIG. 16 shows a pentile type of display pattern when pentile-type pixels display the horizontal pattern of FIG. 15 according to data that are rendered by using a diamond filter (or a diamond-sharpening filter).

FIG. 16 shows a pentile type of display pattern when pentile-type pixels display the horizontal pattern of FIG. 15 according to data that are rendered by using a diamond filter (or a diamond-sharpening filter).

As shown in FIG. 16, the red subpixels and the green subpixels (or the blue subpixels and the green subpixels) of the pixels for displaying the white background emit light. The pixels for displaying the black (or darker) color horizontal lines do not emit light, or emit relatively little (or less) light than neighboring pixels. This arrangement can cause the lattice effect described above with reference to FIG. 2B(b) and FIG. 3B(b).

Figure 17:
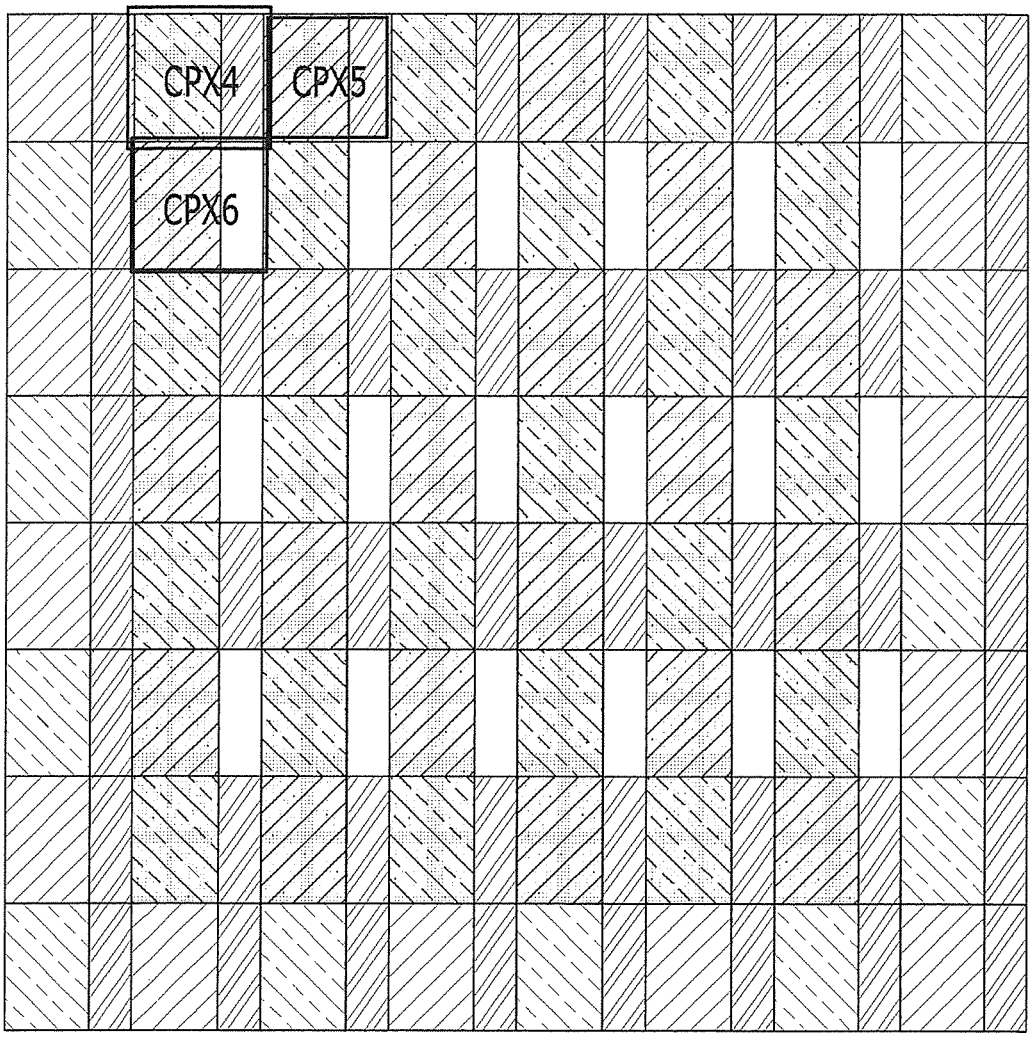
FIG. 17 shows a pentile type of display pattern when pentile-type pixels display the horizontal pattern of FIG. 15 according to rendered data using a data rendering method according to an exemplary embodiment of the present invention.

FIG. 17 shows a pentile type of display pattern when pentile-type pixels display the horizontal pattern of FIG. 15 according to rendered data using a data rendering method according to an exemplary embodiment of the present invention.

As shown in FIG. 17, the red subpixels and the blue subpixels of the pixels on top and bottom of the pixels including the green subpixels forming the horizontal pattern emit light with a set brightness (for example, a predetermined brightness). That is, these red and blue subpixels have much closer luminance to those red and blue subpixels included in the pixels having the green subpixels that form the horizontal lines than in FIG. 16, thus reducing or eliminating the lattice effect observed in FIG. 16.

In further detail, FIG. 15 shows three 3×3 pattern detecting windows PW4, PW5, and PW6, centered at (RGB) pixels PX6, PX8, and PX10, respectively. These respectively correspond to target (pentile) pixels CPX4, CPX5, and CPX6 of FIG. 17. It should be noted that the top row of pattern detecting windows PW4 and PW5 extends past the display area. That is, PX7 and PX9 do not correspond to actual pixels. Rather, PX7 and PX9 correspond to an unlit border area surrounding the display area. As such, input data for this border area can be assumed to be 0 (or other appropriate value corresponding to not emitting light).

When the input data of the pattern detecting window PW4 shown in FIG. 15 are analyzed, a fifth threshold pattern, that is, pattern 1*e*, is detected from the horizontal patterns shown in FIG. 5. As a result, the second filter 400 vertically spreads (using the vertical spread filter of FIG. 8) blue input data of the target pixel CPX4 using pixels PX6 and PX7 corresponding to the target pixel CPX4 and the pixel (or, in this case, the border area) on top of the target pixel CPX4 to generate the target data of the blue subpixel of the target pixel CPX4.

When the input data of the pattern detecting window PW5 that is acquired by shifting the pattern detecting window PW4 by one pixel to the right are analyzed, the first horizontal pattern 1*a* shown in FIG. 5 is detected. The second filter 400 vertically spreads the red input data of the target pixel CPX5 using pixels PX8 and PX9 corresponding to the target pixel CPX5 and the pixel (or, in this case, the border area) on top of the target pixel CPX5 to generate the target data of the red subpixel of the target pixel CPX5.

When the input data of one line of pixels are rendered according to the above-noted method, the input data of the next line of pixels are rendered in a like manner. For instance, when the input data of the pattern detecting window PW6 that is acquired by moving the pattern detecting window PW4 down one pixel to the next line of pixels are analyzed, no threshold pattern of FIG. 5 is detected. As such, the first filter 300 processes the red input data of the target pixel CPX6. However, as the pattern detecting moves to the right, a seventh horizontal threshold pattern 1*g* shown in FIG. 5 is detected. As a result, the second filter 400 vertically spreads the blue input data of the corresponding target pixel to the right of CPX6. In a similar manner, the same horizontal threshold pattern 1*g* is detected (and the second filter 400 performs vertical spreading) for several more contiguous pixels as the pattern detecting window continues moving to the right.

Continuing in this fashion, when the horizontal patterns are detected according to the above-noted method, the black lines on the white background changed by the vertical spread pattern shown in FIG. 17 through vertical spreading are displayed.

When the cross pattern 3 shown in FIG. 5 is detected, the horizontal/vertical spread filter is applicable. In addition, the horizontal/vertical spread filter is applicable in case of the vertical pattern or the horizontal pattern shown in FIG. 5. An application example of the horizontal/vertical spread filter will now be described with reference to FIG. 18 to FIG. 20. An example of the vertical pattern will be used to describe the application example of the horizontal/vertical spread filter.

Figure 18:
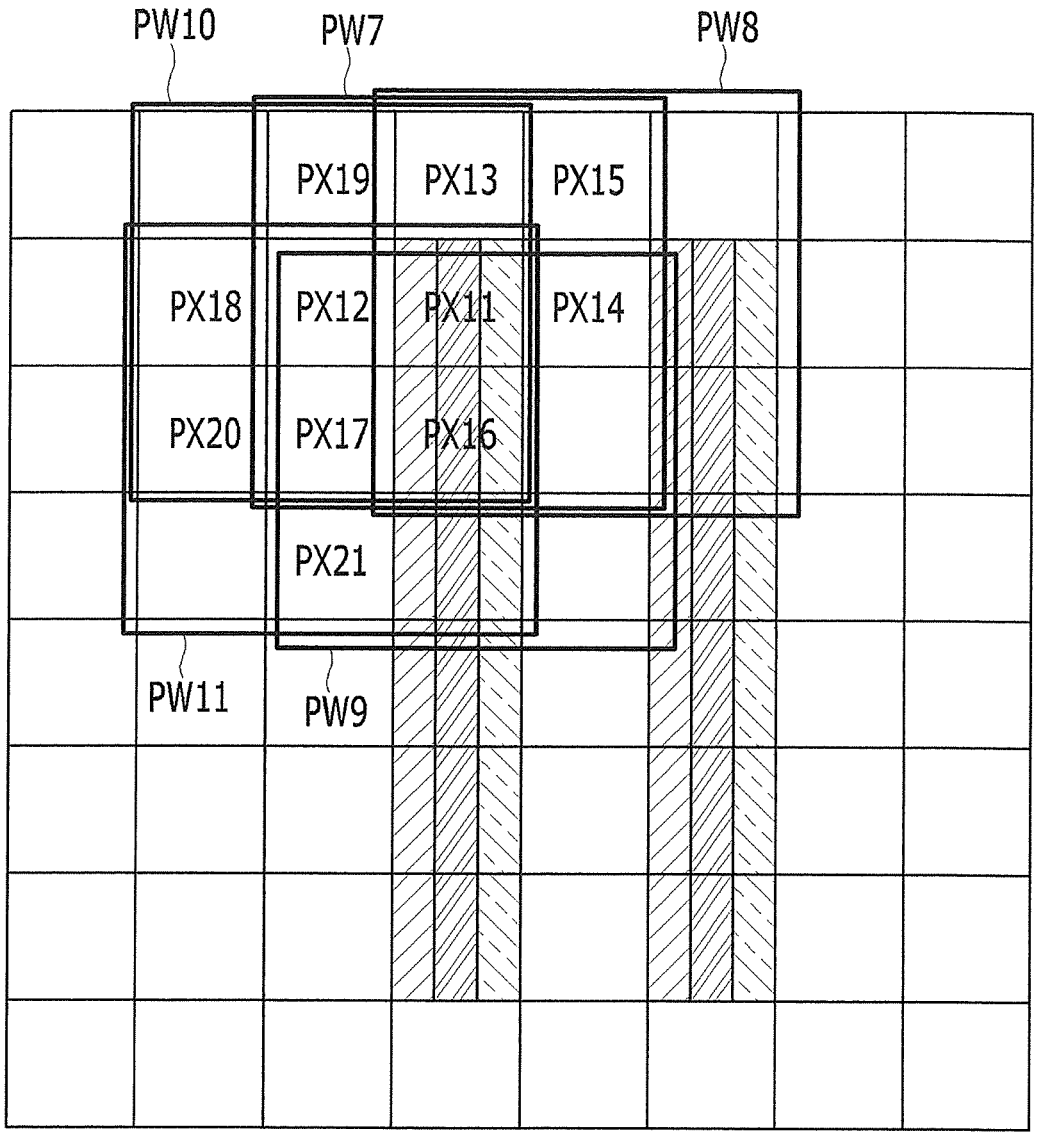
FIG. 18 shows an RGB stripe type of display pattern when RGB stripe-type pixels display a vertical pattern.

FIG. 18 shows a RGB stripe type of display pattern when RGB stripe-type pixels display a vertical pattern.

As shown in FIG. 18, white vertical lines are provided in a display pattern against a black background. In this instance, a pattern detector according to another exemplary embodiment of the present invention can generate the target data by using the horizontal/vertical spread filter from among the second filter 400. The second filter 400 can use the horizontal/vertical spread filter shown in FIG. 10 or FIG. 11. A method for rendering adaptive data using a horizontal/vertical spread filter shown in FIG. 10 will now be described with reference to FIG. 19.

Figure 19:
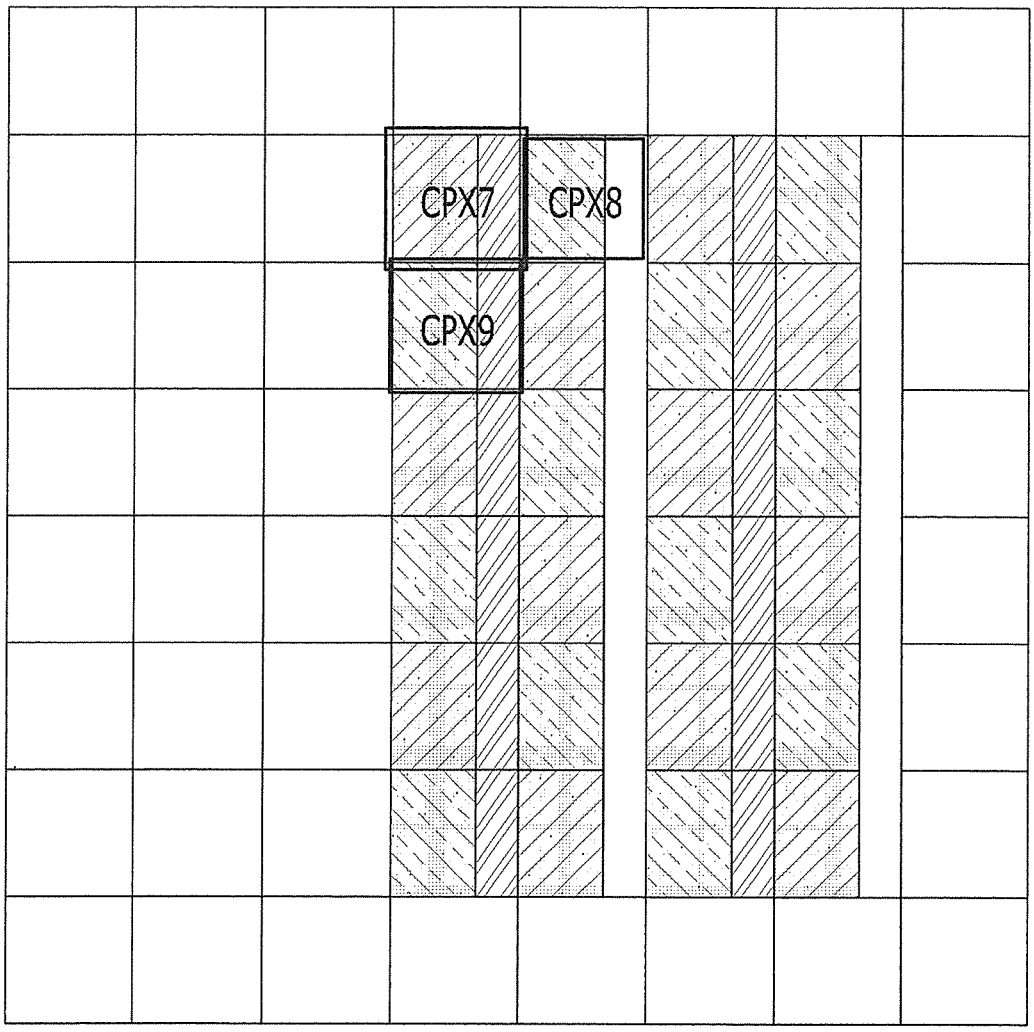
FIG. 19 shows a display pattern of pentile-type pixels when the pentile-type pixels display the vertical pattern of FIG. 18 according to rendered data that are generated by a horizontal/vertical spread filter (shown in FIG. 10) according to an exemplary embodiment of the present invention.

FIG. 19 shows a display pattern of pentile-type pixels when the pentile-type pixels display the vertical pattern of FIG. 18 according to rendered data that are generated by a horizontal/vertical spread filter (shown in FIG. 10) according to an exemplary embodiment of the present invention.

As shown in FIG. 19, when the green subpixels define the vertical lines, the red and blue subpixels on both sides of these green subpixels emit light with a set brightness (for example, a predetermined brightness). That is, these red and blue subpixels have much closer luminance than in FIG. 18, thus reducing or eliminating any greenish effect observed in FIG. 18.

In further detail, FIG. 18 shows three 3×3 pattern detecting windows PW7, PW8, and PW9, centered at (RGB) pixels PX11, PX14, and PX16, respectively. These respectively correspond to target (pentile) pixels CPX7, CPX8, and CPX9 of FIG. 19. When the input data of the pattern detecting window PW7 shown in FIG. 18 are analyzed, a vertical line of emitting green subpixels is detected, specifically the third vertical pattern 2*c* of the threshold patterns of FIG. 5. As a result, the second filter 400 horizontally and vertically spreads (using the horizontal/vertical spread filter of FIG. 10) the red input data of a target pixel CPX7 using pixels PX11, PX12, and PX13 respectively corresponding to the target pixel CPX7, the pixel to the left of the target pixel CPX7, and the pixel on top of the target pixel CPX7 to generate the target data of the red subpixel of the target pixel CPX7.

When the input data of the pattern detecting window PW8 that is acquired by shifting the pattern detecting window PW7 by one pixel to the right are analyzed, two vertical lines of emitting green subpixels are detected, specifically the sixth vertical pattern 2*f* of the threshold patterns of FIG. 5. As a result, the second filter 400 horizontally and vertically spreads the blue input data of a target pixel CPX8 using pixels PX14, PX11, and PX15 respectively corresponding to the target pixel CPX8, the pixel to the left of the target pixel CPX8, and the pixel on top of the target pixel CPX8 to generate the target data of the blue subpixel of the target pixel CPX8.

When the input data of one line of pixels are rendered as described above, the input data of the next line of pixels are rendered in a like manner. For instance, when the input data of the pattern detecting window PW9 that is acquired by moving the pattern detecting window PW7 down one pixel to the next line of pixels are analyzed, a vertical line of emitting green subpixels is detected, specifically the first vertical pattern 2*a* of the threshold patterns of FIG. 5. As a result, the second filter 400 horizontally and vertically spreads the blue input data of a target pixel CPX9 using pixels PX16, PX17, and PX11 respectively corresponding to the target pixel CPX9, the pixel to the left of the target pixel CPX9, and the pixel on top of the target pixel CPX9 to generate the target data of the blue subpixel of the target pixel CPX9.

Continuing in this fashion, when the vertical lines of emitting green subpixels are detected according to the above-noted method, the image with the pattern shown in FIG. 19 is displayed through horizontal/vertical spreading.

A method for rendering input data using a horizontal/vertical spread filter shown in FIG. 11 will now be described with reference to FIG. 20.

Figure 20:
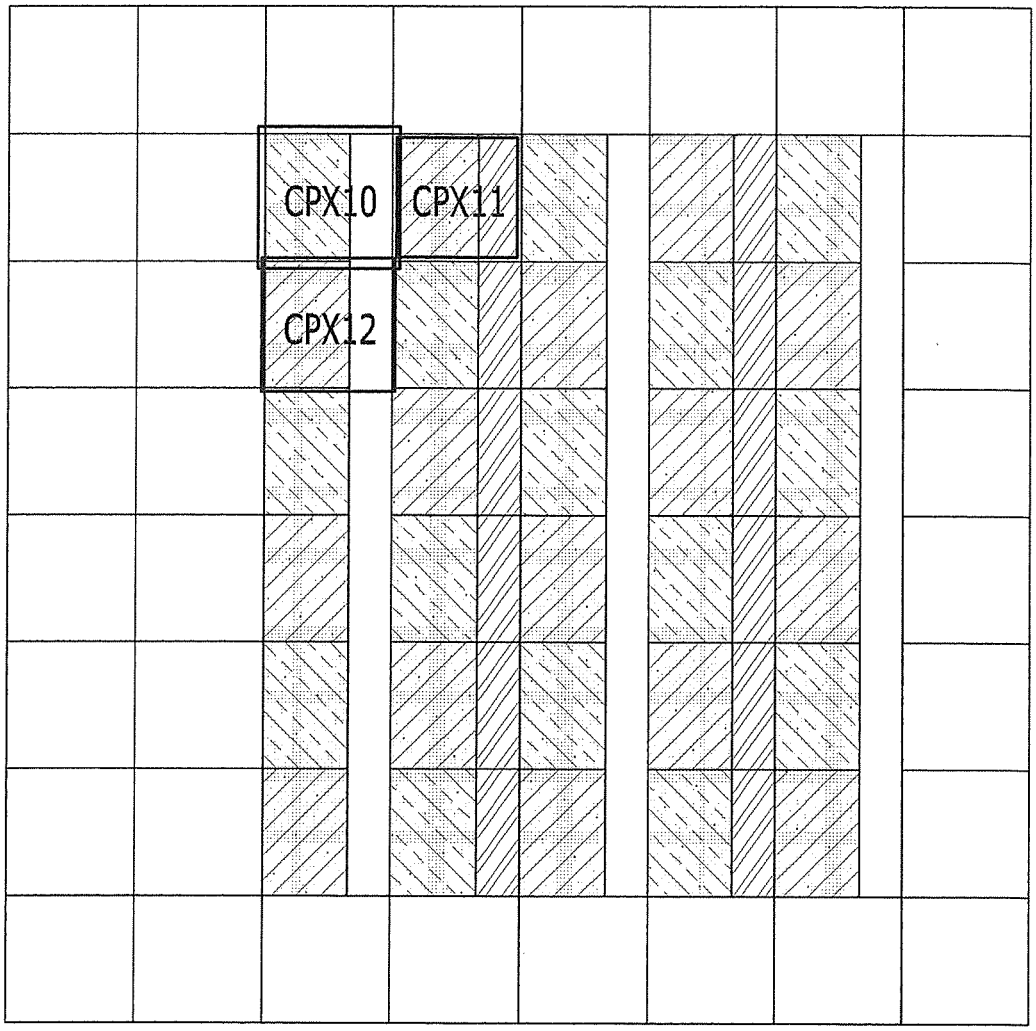
FIG. 20 shows a display pattern of pentile-type pixels when the pentile-type pixels display the vertical pattern of FIG. 18 according to rendered data that are generated by a horizontal/vertical spread filter (shown in FIG. 11) according to an exemplary embodiment of the present invention.

FIG. 20 shows a display pattern of pentile-type pixels when the pentile-type pixels display the vertical pattern of FIG. 18 according to rendered data that are generated by a horizontal/vertical spread filter (shown in FIG. 11) according to an exemplary embodiment of the present invention.

As shown in FIG. 20, when the green subpixels define the vertical lines, the red subpixels and the blue subpixels on both sides of these green subpixels emit light with a set brightness (for example, a predetermined brightness). That is, these red and blue subpixels have much closer luminance than in FIG. 18, thus reducing or eliminating any greenish effect observed in FIG. 18.

In further detail, FIG. 18 shows three 3×3 pattern detecting windows PW10, PW7, and PW11, centered at (RGB) pixels PX12, PX11, and PX17, respectively. These respectively correspond to target (pentile) pixels CPX10, CPX11, and CPX12 of FIG. 20. When the input data of the pattern detecting window PW10 shown in FIG. 18 are analyzed, no threshold pattern of FIG. 5 is detected. As such, the first filter 300 processes the blue input data of the target pixel CPX10.

However, when the input data of the pattern detecting window PW7 that is acquired by shifting the pattern detecting window PW10 by one pixel to the right are analyzed, a vertical line of emitting green subpixels is detected, specifically the vertical pattern 2*c* of the threshold patterns of FIG. 5. As a result, the second filter 400 horizontally and vertically spreads (using the horizontal/vertical spread filter of FIG. 11) the red input data of a target pixel CPX11 using pixels PX12, PX14, PX11, PX13, and PX16 respectively corresponding to the target pixel CPX11, the pixels to the left and right of the target pixel CPX11, and the pixels on the top and bottom of the target pixel CPX11 to generate the target data of the red subpixel of the target pixel CPX11. In a similar fashion, other vertical threshold patterns 2*f* and 2*c* are detected (and the second filter 400 performs horizontal/vertical spreading according to the horizontal/vertical spread filter of FIG. 11) as the pattern detecting window continues moving to the right.

When the input data of one line of pixels are rendered as described above, the input data of the next line of pixels are rendered in a like manner. For instance, when the input data of the pattern detecting window PW11 that is acquired by moving the pattern detecting window PW10 down one pixel to the next line of pixels are analyzed, no threshold pattern of FIG. 5 is detected. As such, the first filter 300 processes the red input data of the target pixel CPX12. However, when the pattern detecting window is moved to the right, a vertical line of emitting green subpixels is detected, specifically the vertical pattern 2*a* of the threshold patterns of FIG. 5. As a result, the second filter 400 horizontally and vertically spreads the blue input data of the target pixel to the right of CPX9 using the horizontal/vertical spread filter of FIG. 11. In a similar manner, other vertical threshold patterns 2*g* and 2*a* are detected (and the second filter 400 performs horizontal/vertical spreading according to the horizontal/vertical spread filter of FIG. 11) as the pattern detecting window continues moving to the right.

Continuing in this fashion, when the vertical lines of emitting green subpixels are detected according to the above-noted method, the image of the pattern shown in FIG. 20 is displayed through horizontal/vertical spreading.

As described above, the light emitting pattern that is vertically spread, horizontally spread, or horizontally/vertically spread is displayed through the filter that follows the light emitting pattern of the green subpixels on the pentile type of display panel according to exemplary embodiments of the present invention. Therefore, the problems such as a green line being viewed on the white line and the vertical lattice being viewed can be solved or lessened.

While in the above exemplary embodiments of the present invention, the threshold pattern is detected when at least two contiguously arranged green subpixels emit light, the present invention is not limited thereto. That is, in other embodiments, a pattern detecting means may detect the time when at least three contiguously arranged green subpixels emit light as the threshold pattern. In addition, the size of the pattern detecting window can be set to a different size, such as greater than 3×3.

The above-described filter methods are particularly suited to the exemplary pentile configuration discussed throughout, but the present invention is not limited to this configuration. That is, when the pentile configuration is changed, other filter methods (for example, which consider the changed pentile configuration) are applicable as exemplary embodiments of the present invention. A display device according to an exemplary embodiment of the present invention will now be described with reference to FIG. 21.

Figure 21:
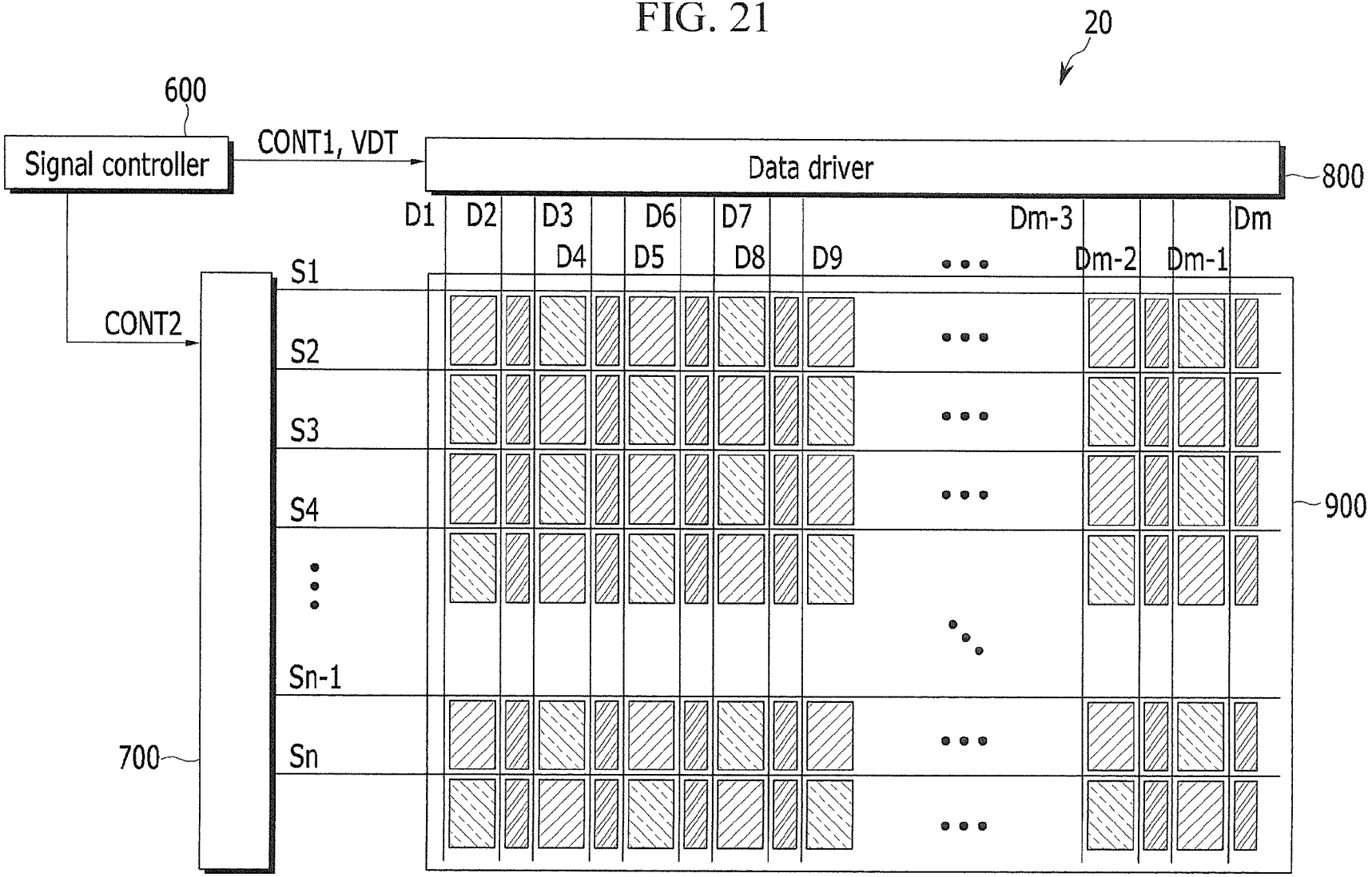
FIG. 21 is a schematic view of a display device according to an exemplary embodiment of the present invention.

FIG. 21 is a schematic view of a display device 20 according to an exemplary embodiment of the present invention.

The display device 20 includes a signal controller 600, a gate driver 700, a data driver 800, and a display panel 900. The signal controller 600 includes a data rendering device 10, such as the data rendering device 10 of FIG. 4. However, the present invention is not restricted thereto, and the two components may be separately formed in other embodiments.

The signal controller 600 generates a first drive control signal (CONT1) for controlling the data driver 800 and a second drive control signal (CONT2) for controlling the gate driver 700. The first drive control signal CONT1 and the second drive control signal CONT2 may include, for example, a vertical synchronization signal for distinguishing a frame of an image, a horizontal synchronization signal for distinguishing a line of a frame, and a data enable signal for controlling a period for applying data voltages to a plurality of data lines D1-Dm.

The signal controller 600 also generates gamma data for adjusting luminance according to the rendered data stored in a source buffer 500 of the data rendering device 10, arranges the gamma data to generate a data signal (VDT), and transmits the data signal (VDT) and the first drive control signal (CONT1) to the data driver 800. The second drive control signal (CONT2) is transmitted to the gate driver 700.

The gate driver 700 transmits a plurality of gate signals (G[1]-G[n]) to a plurality of gate lines S1-Sn according to the second drive control signal (CONT2). Further, the data driver 800 transforms the data signal (VDT) into a plurality of data voltages (D[1]-D[m]) according to the first drive control signal (CONT1), and transmits the data voltages D[1]-D[m] to the plurality of data lines D1-Dm. In addition, the display panel 900 includes the plurality of gate lines S1-Sn, the plurality of data lines D1-Dm, and a plurality of pentile-type subpixels formed at crossing regions of the gate lines S1-Sn and data lines D1-Dm.

The gate lines S1-Sn are formed in the horizontal direction. The data lines D1-Dm are formed in the vertical direction. Respective subpixels (a plurality of shaded boxes in FIG. 21) are coupled to corresponding ones of the gate lines S1-Sn and corresponding ones of the data lines D1-Dm. The gate line corresponding to the subpixel represents a gate line that is nearest to the top of the subpixel, while the corresponding data line represents a data line that is nearest to the left of the subpixel.

Figure 22:
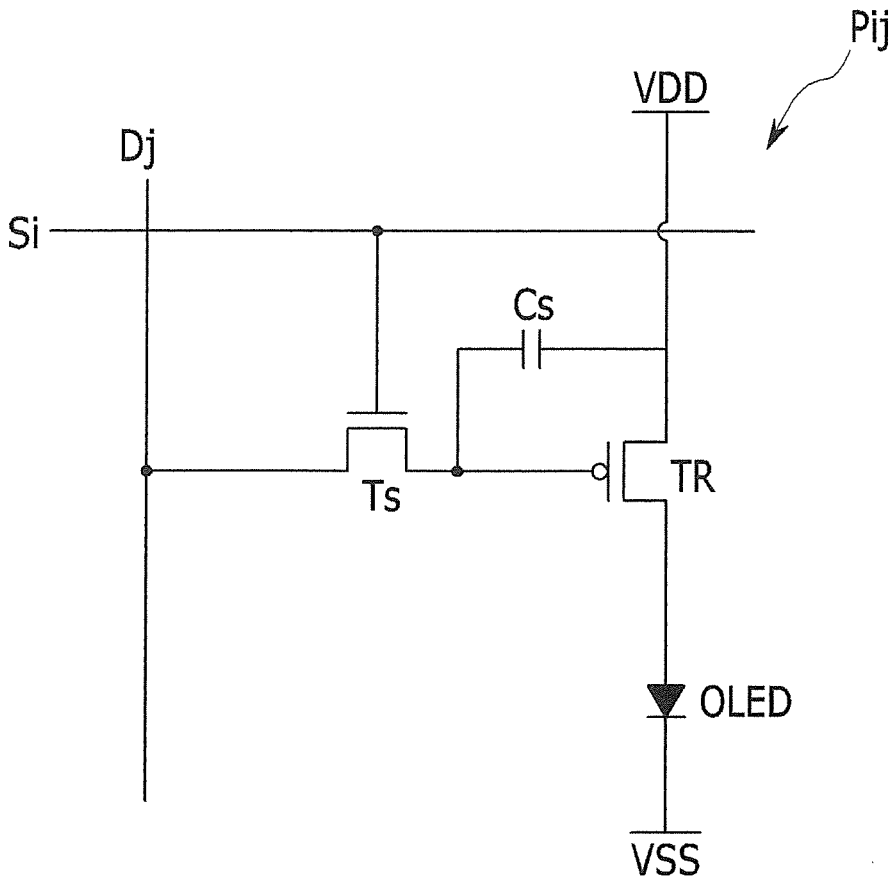
FIG. 22 is a circuit view of a driving circuit of a subpixel and a light emitting element according to an exemplary embodiment of the present invention.

FIG. 22 is a circuit view of a driving circuit of a subpixel Pij and a light emitting element OLED according to an exemplary embodiment of the present invention.

The subpixel Pij shown in FIG. 22 is coupled to an i-th scan line (gate line) Si and a j-th data line Dj. As shown in FIG. 22, the subpixel (Pij) includes a switching transistor (TS), a driving transistor (TR), and a storage capacitor (CS). A cathode of the organic light emitting diode (OLED) is coupled to a second voltage source (VSS).

The switching transistor (TS) includes a gate electrode coupled to the gate line Si, a first electrode coupled to the data line (Dj), and a second electrode coupled to a first terminal of the storage capacitor CS. The driving transistor (TR) includes a gate electrode coupled to the second electrode of the switching transistor (TS), a source electrode coupled to a first voltage source VDD, and a drain electrode coupled to an anode of the organic light emitting diode (OLED). The storage capacitor (CS) includes the first terminal coupled to the gate electrode of the driving transistor TR and a second terminal coupled to the source electrode of the driving transistor (TR).

When the switching transistor (TS) is turned on by a gate signal with a gate-on voltage transmitted through the gate line Si, a data voltage is transmitted to the gate electrode of the driving transistor (TR) through the data line (Dj). A voltage corresponding to the data voltage transmitted to the gate electrode of the driving transistor (TR) is maintained by the storage capacitor (CS). A driving current corresponding to the voltage maintained by the storage capacitor (CS) flows to the driving transistor (TR). The driving current flows to the organic light emitting diode (OLED), and the organic light emitting diode (OLED) emits light with the luminance that corresponds to the driving current.

While the present invention has been described in connection with what is presently considered to be practical exemplary embodiments, it is to be understood that the present invention is not limited to the disclosed embodiments, but, on the contrary, is intended to cover various modifications and equivalent arrangements included within the spirit and scope of the appended claims, and equivalents thereof.

What is claimed is:

1. A method for rendering input data for input pixels each comprising exactly three input subpixels comprising a green subpixel, a red input subpixel, and a blue input subpixel, into target data for a same number of corresponding target pixels each comprising exactly two target subpixels comprising a corresponding said green subpixel and either a red target subpixel or a blue target subpixel, the method comprising:

applying a pattern detecting window with a predetermined size to the input data about one of the input pixels to detect a green light emitting pattern of the green subpixels within the pattern detecting window;

determining whether the detected green light emitting pattern belongs to a threshold pattern in which at least two of the green subpixels that are contiguously arranged within the pattern detecting window emit light exceeding a first luminance value;

rendering the target data for the red or blue target subpixel of one of the target pixels that corresponds to the one of the input pixels and has a first color while maintaining the target data for the green subpixel of the one of the target pixels to be equivalent to the input data for the green subpixel of the one of the input pixels by:

applying a first filter to the input data of said first color ones of the red and blue input subpixels that are in or near the one of the input pixels when the detected green light emitting pattern does not belong to the threshold pattern; and applying a second filter that is different from the first filter to the input data of the first color ones of the red and blue input subpixels that are in or near the one of the input pixels when the detected green light emitting pattern belongs to the threshold pattern; and moving the pattern detecting window to render the target data for the red or blue target subpixel of another one of the target pixels, wherein the threshold pattern includes a horizontal pattern in which the at least two of the green subpixels that are contiguously arranged are arranged in a horizontal direction, and the applying of the second filter comprises:

multiplying the input data of the first color one of the red and blue input subpixels of the one of the input pixels by a first filter variable to generate a first product;

multiplying the input data of the first color one of the red and blue input subpixels of a neighboring top or bottom one of the input pixels of the one of the input pixels by a second filter variable to generate a second product; and adding the first product and the second product.

2. The method of claim 1, wherein the predetermined size encompasses those input pixels from at least three rows of the input pixels and at least three columns of the input pixels.

3. The method of claim 1, wherein a sum of the first filter variable and the second filter variable is 1.

4. A method for rendering input data for input pixels each comprising exactly three input subpixels comprising a green subpixel, a red input subpixel, and a blue input subpixel, into target data for a same number of corresponding target pixels each comprising exactly two target subpixels comprising a corresponding said green subpixel and either a red target subpixel or a blue target subpixel, the method comprising:

applying a pattern detecting window with a predetermined size to the input data about one of the input pixels to detect a green light emitting pattern of the green subpixels within the pattern detecting window;

determining whether the detected green light emitting pattern belongs to a threshold pattern in which at least two of the green subpixels that are contiguously arranged within the pattern detecting window emit light exceeding a first luminance value;

rendering the target data for the red or blue target subpixel of one of the target pixels that corresponds to the one of the input pixels and has a first color while maintaining the target data for the green subpixel of the one of the target pixels to be equivalent to the input data for the green subpixel of the one of the input pixels by:

applying a first filter to the input data of said first color ones of the red and blue input subpixels that are in or near the one of the input pixels when the detected green light emitting pattern does not belong to the threshold pattern; and applying a second filter that is different from the first filter to the input data of the first color ones of the red and blue input subpixels that are in or near the one of the input pixels when the detected green light emitting pattern belongs to the threshold pattern; and moving the pattern detecting window to render the target data for the red or blue target subpixel of another one of the target pixels, wherein the threshold pattern includes a vertical pattern in which the at least two of the green subpixels that are contiguously arranged are arranged in a vertical direction, and the applying of the second filter comprises:

multiplying the input data of the first color one of the red and blue input subpixels of the one of the input pixels by a first filter variable to generate a first product;

multiplying the input data of the first color one of the red and blue input subpixels of a neighboring left or right one of the input pixels of the one of the input pixels by a second filter variable to generate a second product; and adding the first product and the second product.

5. The method of claim 4, wherein a sum of the first filter variable and the second filter variable is 1.

6. A method for rendering input data for input pixels each comprising exactly three input subpixels comprising a green subpixel, a red input subpixel, and a blue input subpixel, into target data for a same number of corresponding target pixels each comprising exactly two target subpixels comprising a corresponding said green subpixel and either a red target subpixel or a blue target subpixel, the method comprising:

applying a pattern detecting window with a predetermined size to the input data about one of the input pixels to detect a green light emitting pattern of the green subpixels within the pattern detecting window;

determining whether the detected green light emitting pattern belongs to a threshold pattern in which at least two of the green subpixels that are contiguously arranged within the pattern detecting window emit light exceeding a first luminance value;

rendering the target data for the red or blue target subpixel of one of the target pixels that corresponds to the one of the input pixels and has a first color while maintaining the target data for the green subpixel of the one of the target pixels to be equivalent to the input data for the green subpixel of the one of the input pixels by:

applying a first filter to the input data of said first color ones of the red and blue input subpixels that are in or near the one of the input pixels when the detected green light emitting pattern does not belong to the threshold pattern; and applying a second filter that is different from the first filter to the input data of the first color ones of the red and blue input subpixels that are in or near the one of the input pixels when the detected green light emitting pattern belongs to the threshold pattern; and moving the pattern detecting window to render the target data for the red or blue target subpixel of another one of the target pixels, wherein the threshold pattern includes a cross pattern in which the at least two of the green subpixels that are contiguously arranged are arranged to cross in a vertical direction and a horizontal direction, and the applying of the second filter comprises:

multiplying the input data of the first color one of the red and blue input subpixels of the one of the input pixels by a first filter variable to generate a first product;

multiplying the input data of the first color one of the red and blue input subpixels of a neighboring top or bottom one of the input pixels of the one of the input pixels by a second filter variable to generate a second product;

multiplying the input data of the first color one of the red and blue input subpixels of a neighboring left or right one of the input pixels of the one of the input pixels by a third filter variable to generate a third product; and adding the first product, the second product, and the third product.

7. The method of claim 6, wherein a sum of the first filter variable, the second filter variable, and the third filter variable is 1.

8. The method of claim 6, wherein the applying of the second filter further comprises:

multiplying the input data of the first color one of the red and blue input subpixels of a different neighboring one of the input pixels of the one of the input pixels by a fourth filter variable to generate a fourth product; and adding the first product, the second product, the third product, and the fourth product.

9. The method of claim 8, wherein a sum of the first to the fourth filter variables is 1.

10. The method of claim 8, wherein the applying of the second filter further comprises:

multiplying the input data of the first color one of the red and blue input subpixels of another different neighboring one of the input pixels of the one of the input pixels by a fifth filter variable to generate a fifth product; and adding the first product, the second product, the third product, the fourth product, and the fifth product.

11. The method of claim 10, wherein a sum of the first to the fifth filter variables is 1.

12. A device for rendering input data for controlling brightness of input pixels having an RGB stripe configuration and each comprising exactly three input subpixels comprising a green subpixel, a red input subpixel, and a blue input subpixel, into target data for a same number of corresponding target pixels having a pentile configuration and each comprising exactly two target subpixels comprising a corresponding said green subpixel and either a red target subpixel or a blue target subpixel, the device comprising:

a pattern detector for:

applying a pattern detecting window with a predetermined size to the input data about one of the input pixels to detect a green light emitting pattern of the green subpixels within the pattern detecting window; and determining whether the detected green light emitting pattern belongs to a threshold pattern in which at least two of the green subpixels that are contiguously arranged within the pattern detecting window emit light exceeding a first luminance value; and a target data renderer for rendering the target data for the red or blue target subpixel of one of the target pixels that corresponds to the one of the input pixels and has a first color while maintaining the target data for the green subpixel of the one of the target pixels to be equivalent to the input data for the green subpixel of the one of the input pixels, the target data renderer comprising:

a first filter for rendering the target data for the red or blue target subpixel of the one of the target pixels by using the input data of said first color ones of the red and blue input subpixels that are in or near the one of the input pixels when the detected green light emitting pattern does not belong to the threshold pattern; and a second filter for rendering the target data for the red or blue target subpixel by using the input data of the first color ones of the red and blue input subpixels that are in or near the one of the input pixels when the detected green light emitting pattern belongs to the threshold pattern, wherein the threshold pattern includes a horizontal pattern in which at least two of the green subpixels that are contiguously arranged are arranged in a horizontal direction, and the second filter is configured to:

multiply the input data of the first color one of the red and blue input subpixels of the one of the input pixels by a first filter variable to generate a first product:

multiply the input data of the first color one of the red and blue input subpixels of a neighboring top or bottom one of the input pixels of the one of the input pixels by, a second filter variable to generate a second product; and add the first product and the second product.

13. The device of claim 12, further comprising an input data buffer for storing as many lines of the input data as a number of rows of pixels in the pattern detecting window, wherein each of the lines of the input data is for controlling light emission of the input pixels of one row in the RGB stripe configuration.

14. The device of claim 12, wherein a sum of the first filter variable and the second filter variable is 1.

15. A device for rendering input data for controlling brightness of input pixels having an RGB stripe configuration and each comprising exactly three input subpixels comprising a green subpixel, a red input subpixel, and a blue input subpixel, into target data for a same number of corresponding target pixels having a pentile configuration and each comprising exactly two target subpixels comprising a corresponding said green subpixel and either a red target subpixel or a blue target subpixel, the device comprising:

a pattern detector for:

applying a pattern detecting window with a predetermined size to the input data about one of the input pixels to detect a green light emitting pattern of the green subpixels within the pattern detecting window; and determining whether the detected green light emitting pattern belongs to a threshold pattern in which at least two of the green subpixels that are contiguously arranged within the pattern detecting window emit light exceeding a first luminance value; and a target data renderer for rendering the target data for the red or blue target subpixel of one of the target pixels that corresponds to the one of the input pixels and has a first color while maintaining the target data for the green subpixel of the one of the target pixels to be equivalent to the input data for the green subpixel of the one of the input pixels, the target data renderer comprising:

a first filter for rendering the target data for the red or blue target subpixel of the one of the target pixels by using the input data of said first color ones of the red and blue input subpixels that are in or near the one of the input pixels when the detected green light emitting pattern does not belong to the threshold pattern; and a second filter for rendering the target data for the red or blue target subpixel by using the input data of the first color ones of the red and blue input subpixels that are in or near the one of the input pixels when the detected green light emitting pattern belongs to the threshold pattern, wherein the threshold pattern includes a vertical pattern in which the at least two of the green subpixels that are contiguously arranged are arranged in a vertical direction, and the second filter is configured to:

multiply the input data of the first color one of the red and blue input subpixels of the one of the input pixels by a first filter variable to generate a first product;

multiply the input data of the first color one of the red and blue input subpixels of a neighboring left or right one of the input pixels of the one of the input pixels by a second filter variable to generate a second product; and add the first product and the second product.

16. The device of claim 15, wherein a sum of the first filter variable and the second filter variable is 1.

17. A device for rendering input data for controlling brightness of input pixels having an RGB stripe configuration and each comprising exactly three input subpixels comprising a green subpixel, a red input subpixel, and a blue input subpixel, into target data for a same number of corresponding target pixels having a pentile configuration and each comprising exactly two input subpixels comprising a corresponding said green subpixel and either a red target subpixel or a blue target subpixel, the device comprising:

a pattern detector for:

applying a pattern detecting window with a predetermined size to the input data about one of the input pixels to detect a green light emitting pattern of the green subpixels within the pattern detecting window; and determining whether the detected green light emitting pattern belongs to a threshold pattern in which at least two of the green subpixels that are contiguously arranged within the pattern detecting window emit light exceeding a first luminance value; and a target data renderer for rendering the target data for the red or blue target subpixel of one of the target pixels that corresponds to the one of the input pixels and has a first color while maintaining the target data for the green subpixel of the one of the target pixels to be equivalent to the input data for the green subpixel of the one of the input pixels, the target data renderer comprising:

a first filter for rendering the target data for the red or blue target subpixel of the one of the target pixels by using the input data of said first color ones of the red and blue input subpixels that are in or near the one of the input pixels when the detected green light emitting pattern does not belong to the threshold pattern; and a second filter for rendering the target data for the red or blue target subpixel by using the input data of the first color ones of the red and blue input subpixels that are in or near the one of the input pixels when the detected green light emitting pattern belongs to the threshold pattern, wherein the threshold pattern includes a cross pattern in which the at least two of the green subpixels that are contiguously arranged are arranged to cross in a vertical direction and a horizontal direction, and the second filter is configured to:

multiply the input data of the first color one of the red and blue input subpixels of the one of the input pixels by a first filter variable to generate a first product;

multiply the input data of the first color one of the red and blue input subpixels of a neighboring top or bottom one of the input pixels of the one of the input pixels by a second filter variable to generate a second product;

multiply the input data of the first color one of the red and blue input subpixels of a neighboring left or right one of the input pixels of the one of the input pixels by a third filter variable to generate a third product; and add the first product, the second product, and the third product.

18. The device of claim 17, wherein a sum of the first filter variable, the second filter variable, and the third filter variable is 1.

19. The device of claim 17, wherein the second filter is further configured to:

multiply the input data of the first color one of the red and blue input subpixels of a different neighboring one of the input pixels of the one of the input pixels by a fourth filter variable to generate a fourth product; and add the first product, the second product, the third product, and the fourth product.

20. The device of claim 19, wherein a sum of the first to the fourth filter variables is 1.

21. The device of claim 19, wherein the second filter is further configured to:

multiply the input data of the first color one of the red and blue input subpixels of another different neighboring one of the input pixels of the one of the input pixels by a fifth filter variable to generate a fifth product; and add the first product, the second product, the third product, the fourth product, and the fifth product.

22. The device of claim 21, wherein a sum of the first to the fifth filter variables is 1.

23. A display device comprising:

a pentile type of display panel including a plurality of gate lines for transmitting a plurality of gate signals, a plurality of data lines for transmitting a plurality of data voltages, and a plurality of subpixels respectively coupled to corresponding ones of the plurality of gate lines and corresponding ones of the plurality of data lines, a green subpixel and either a red subpixel or a blue subpixel of the subpixels constituting a pixel of the display panel; and a data driver for generating the plurality of data voltages, wherein the plurality of data voltages are determined by target data corresponding to the plurality of subpixels, and the target data are rendered from input data for controlling brightness of input pixels having an RGB stripe configuration by the device of any one of claims 12-13 and 14-22.

* * * * *